US010732542B2

(12) United States Patent
Tanaka et al.

(10) Patent No.: US 10,732,542 B2
(45) Date of Patent: Aug. 4, 2020

(54) IMAGE FORMING APPARATUS FOR INCREASE OF COLOR TONER IN A COLOR TONER IMAGE IN A SPECIAL OPERATION

(71) Applicants: Masato Tanaka, Tokyo (JP); Keiji Kunimi, Kanagawa (JP); Masanori Kawasumi, Kanagawa (JP)

(72) Inventors: Masato Tanaka, Tokyo (JP); Keiji Kunimi, Kanagawa (JP); Masanori Kawasumi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/232,448

(22) Filed: Dec. 26, 2018

(65) Prior Publication Data

US 2019/0196363 A1 Jun. 27, 2019

(30) Foreign Application Priority Data

Dec. 27, 2017 (JP) ..... 2017-252310
Sep. 27, 2018 (JP) ..... 2018-182334

(51) Int. Cl.
*G03G 15/08* (2006.01)
*G03G 9/087* (2006.01)
(Continued)

(52) U.S. Cl.
CPC ..... *G03G 15/0865* (2013.01); *G03G 9/08706* (2013.01); *G03G 9/09* (2013.01);
(Continued)

(58) Field of Classification Search
USPC ..... 399/262
See application file for complete search history.

(56) References Cited

U.S. PATENT DOCUMENTS 5,146,270 A * 9/1992 Matsuo ..... G03G 15/01 399/112
7,310,484 B2 * 12/2007 Namba ..... G03G 15/0126 399/223
(Continued)

FOREIGN PATENT DOCUMENTS

JP 7-053945 2/1995
JP 7-271081 10/1995
(Continued)

OTHER PUBLICATIONS

European Office Action dated May 10, 2019.

*Primary Examiner* — Quana Grainger
(74) *Attorney, Agent, or Firm* — Harness, Dickey & Pierce, P.L.C.

(57) ABSTRACT

An image forming apparatus including an image forming unit, a unit holder, and circuitry is provided. The image forming unit includes a color toner unit, a replaceable black toner unit, and a replaceable special toner unit that form a color toner image, a black toner image, and a special toner image, respectively. The unit holder selectively and detachably holds the replaceable black toner unit or the replaceable special toner unit. The circuitry controls the image forming unit to perform: a normal operation, when the unit holder holds the replaceable black toner unit, that forms a color-black image; a special operation, when the unit holder holds the replaceable special toner unit, that forms a color-special image; and a toner amount increase control that increases an amount of the color toner per unit area in the color toner image in the special operation than that in the normal operation.

32 Claims, 11 Drawing Sheets

(51) Int. Cl.

| | |
|---|---|
| ***G03G 9/09*** | (2006.01) |
| ***G03G 21/16*** | (2006.01) |
| ***G03G 15/00*** | (2006.01) |
| ***G03G 21/04*** | (2006.01) |

(52) U.S. Cl.
CPC ..... *G03G 15/6585* (2013.01); *G03G 21/046* (2013.01); *G03G 21/1676* (2013.01)

(56) References Cited

U.S. PATENT DOCUMENTS

| | | | | |
|---|---|---|---|---|
| 8,606,132 | B2 * | 12/2013 | Tanimura | B41J 2/2114 399/223 |
| 2004/0252162 | A1 * | 12/2004 | Gondek | B41J 2/2056 347/43 |
| 2008/0160435 | A1 * | 7/2008 | Lim | G03G 15/0121 430/48 |
| 2009/0268216 | A1 | 10/2009 | Iinuma | |
| 2013/0266347 | A1 | 10/2013 | Kubota et al. | |
| 2019/0196382 | A1 * | 6/2019 | Tanaka | G03G 15/0115 |

FOREIGN PATENT DOCUMENTS

| | | | |
|---|---|---|---|
| JP | 9-077507 | | 3/1997 |
| JP | 9-104857 | | 4/1997 |
| JP | 10-207174 | | 8/1998 |
| JP | 2001-265181 | | 9/2001 |
| JP | 2001-294785 | | 10/2001 |
| JP | 2002-146254 | | 5/2002 |
| JP | 2002351190 | A * | 12/2002 |
| JP | 2003-186238 | | 7/2003 |
| JP | 2003316106 | A * | 11/2003 |
| JP | 2007-003944 | | 1/2007 |
| JP | 2007-171508 | | 7/2007 |
| JP | 2008-076663 | | 4/2008 |
| JP | 2010-113368 | | 5/2010 |
| JP | 2012-032541 | | 2/2012 |
| JP | 5256577 | B2 * | 8/2013 |
| JP | 2016158161 | A | 9/2016 |
| JP | 2018-060169 | | 4/2018 |

* cited by examiner

IMAGE FORMING APPARATUS FOR INCREASE OF COLOR TONER IN A COLOR TONER IMAGE IN A SPECIAL OPERATION

CROSS-REFERENCE TO RELATED APPLICATIONS

This patent application is based on and claims priority pursuant to 35 U.S.C. § 119(a) to Japanese Patent Application Nos. 2017-252310 and 2018-182334, filed on Dec. 27, 2017 and Sep. 27, 2018, respectively, in the Japan Patent Office, the entire disclosure of each of which is hereby incorporated by reference herein.

BACKGROUND

Technical Field

The present disclosure relates to an image forming apparatus and printed matter.

Description of the Related Art

Conventionally, an image forming apparatus is known which is equipped with a unit holder to detachably hold a replaceable black toner unit including a black toner developing device containing black toner and is configured to form a color toner image and a black toner image with a color toner (yellow toner, magenta toner, and/or cyan toner) and the black toner, respectively, to form a visible image on a recording medium.

Recently, an image forming apparatus is known that forms a hardly visible image (i.e., an image that is difficult to visually recognize) with a special toner on a recording medium along with a visible toner. However, there are some cases in which the hardly visible image can be recognized by human eyes because invisibility of the hardly visible image is insufficient.

SUMMARY

In accordance with some embodiments of the present invention, an image forming apparatus is provided. The image forming apparatus includes an image forming unit, a unit holder, and circuitry. The image forming unit includes a color toner unit, a replaceable black toner unit, and a replaceable special toner unit. The color toner unit includes a color toner developing device containing a color toner comprising at least one of yellow toner, magenta toner, and cyan toner, and is configured to form a color toner image with the color toner on a recording medium. The replaceable black toner unit includes a black toner developing device containing black toner, and is configured to form a black toner image with the black toner on the recording medium. The replaceable special toner unit includes a special toner developing device containing a special toner, and is configured to form a special toner image with the special toner on the recording medium. The unit holder is configured to selectively and detachably hold the replaceable black toner unit or the replaceable special toner unit. The circuitry controls the image forming unit to: form a color-black image on the recording medium, including the color toner image and the black toner image, during a normal operation when the unit holder holds the replaceable black toner unit; and form a color-special image on the recording medium, including the color toner image and the special toner image, during a special operation when the unit holder holds the replaceable special toner unit, wherein an amount of the color toner per unit area, in the color toner image formed on the recording medium, is relatively increased during the special operation relative to the normal operation.

In accordance with some embodiments of the present invention, printed matter is provided. The printed matter includes a recording medium and the color-special image formed by the above-described image forming apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
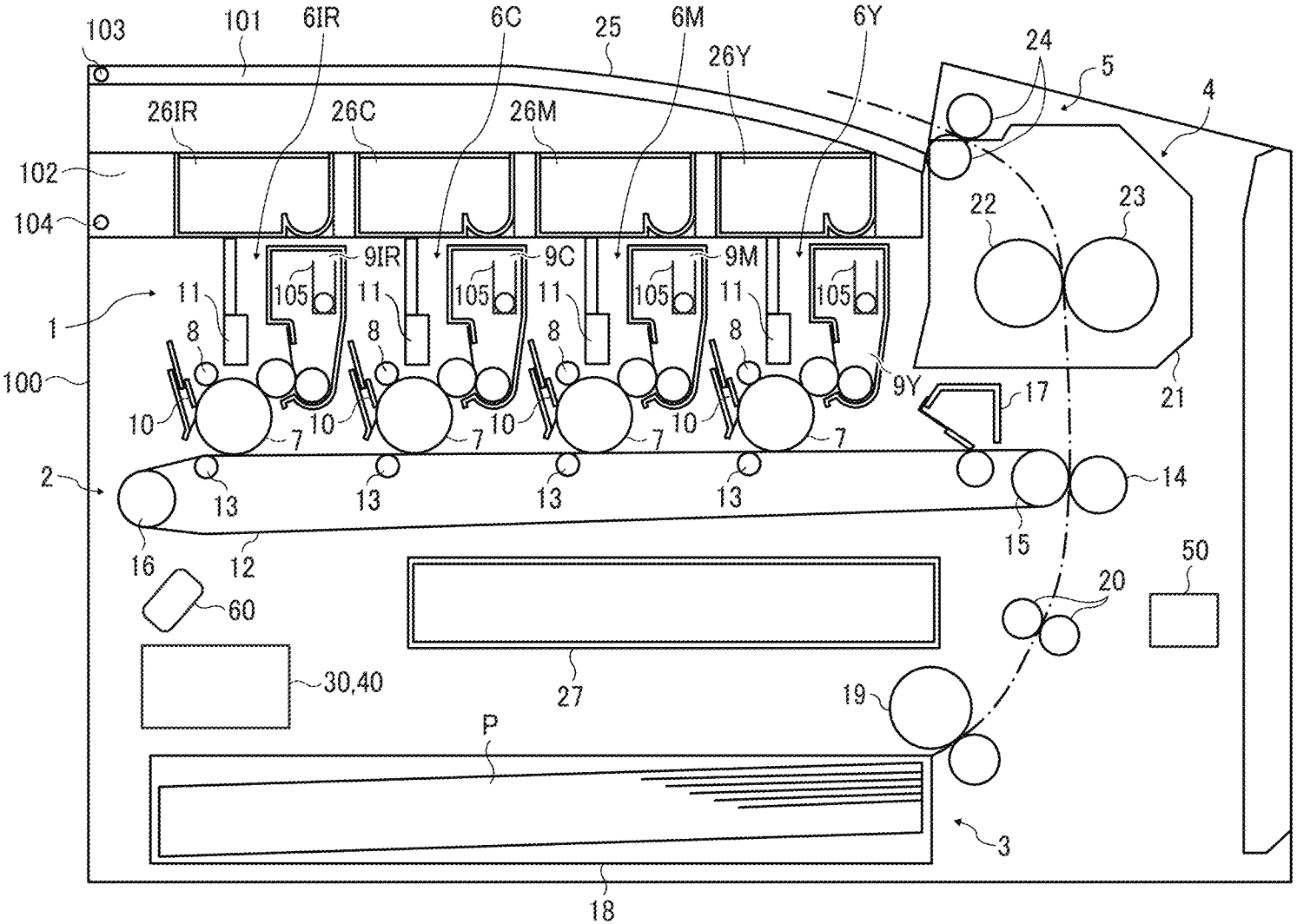
FIG. 1 is a schematic diagram of an image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF THE EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

According to an embodiment of the present invention, invisibility of a hardly visible image is increased to make it more difficult for human eyes to recognize the hardly visible image.

A color printer (hereinafter "printer") that is an image forming apparatus according to an embodiment of the present invention is described with reference to the drawings.

The printer according to the present embodiment is an image forming apparatus having four stations or less. The image forming apparatus is not particularly limited as long as a unit holder to detachably hold a replaceable black toner unit including a black toner developing device configured to form a black toner image with black (K) toner is equipped therein and a color toner image and the black toner image are formed with a color toner (yellow (Y) toner, magenta (M) toner, and/or cyan (C) toner) and the black toner, respectively, to form a black-color image on a recording medium. Therefore, in addition to the printer, the image forming apparatus may be a copier, a facsimile machine, or a multifunction peripheral having at least two functions of a printer, a copier, a facsimile machine, and a scanner.

The printer according to the present embodiment forms a hardly visible image when the replaceable black toner unit held by the unit holder is replaced with a replaceable special toner unit including a special toner developing device configured to form a hardly visible image with a special toner on a recording medium. The special toner is mainly used when embedding additional information in an image. For example, for the purpose of preventing illegal copying, the special toner is used for forming a hardly visible image, called an invisible pattern or ground tint (e.g., a text image such as "COPY" which is impossible for human to recognize at first glance) that is difficult to visually recognize, on a recording medium together with a visible image formed with a color toner. In addition, for the purpose of increasing the amount of information of a code image such as QR code (registered trademark), the special toner is used for forming a hardly visible code image on a visible code image formed on a recording medium in a superimposed manner.

The hardly visible image is an image formed with a toner having higher transparency than general color toner under visible light. The toner according to the present embodiment easily becomes visible by emitting light or developing color upon a processing such as infrared light irradiation.

Examples of the special toner include, but are not limited to, toners capable of absorbing light outside the visible light region or emitting light within the visible light region upon irradiation with light outside the visible light region, such as an infrared absorbing toner having transparency and a transparent fluorescent toner which fluoresces when irradiated with ultraviolet rays. In the present embodiment, an infrared absorbing toner is used as the special toner. In the following description, yellow toner, magenta toner, cyan toner, black toner, and infrared absorbing toner are referred to as Y toner, M toner, C toner, K toner, and IR toner, respectively. Here, the special toner is a toner having a color other than yellow, magenta, cyan, and black, or a transparent toner. The special toner also includes a white toner and a metallic toner. Preferably, the special toner is a transparent toner that is suppressed from developing color under visible light. Also, the special toner has less colorant content than general color toner.

First, the overall configuration and operation of the printer according to the present embodiment is described below.

FIG. 1 is a schematic diagram illustrating the overall configuration of a printer according to the present embodiment.

The printer includes an image former 1, a transferrer 2, a recording medium supplier 3, a fixer 4, a recording medium ejector 5, a processor 30, and an image formation processor 40.

The image former 1 includes four unit holders 105 for holding respective four process units 6 each serving as an image forming unit that is replaceable. Three of the four unit holders 105 respectively hold three process units 6Y, 6M, and 6C containing yellow toner, magenta toner, and cyan toner, respectively. The remaining one unit holder 105 selectively holds a black process unit 6K or an IR process unit 6IR. FIG. 1 illustrates a state in which the IR process unit 6IR, not the black process unit 6K, is held by the unit holder 105. The process units 6Y, 6M, 6C, 6K, and 6IR have the same configuration except for containing different types of toners.

Since the number of the unit holders 105 equipped in the printer according to the present embodiment is four, the size of the printer can be reduced than a printer having five unit holders 105 for respectively holding the five process units 6Y, 6M, 6C, 6K, and 6IR. Accordingly, a small printer having four unit holders is provided that has a function of forming a full-color image (visible color-black image) with Y, M, C, and K toners and another function of forming a combination of a full-color image (visible color image) and an IR image (hardly visible image) with Y, M, and C toners and IR toner, respectively.

Furthermore, all the process units may be detachably configured so that the mounting positions (i.e., unit holders) of the process units can be interchanged with each other. In this case, the positional relationship (in the toner image stacking direction) between an IR toner image and each color toner image on a recording medium can be appropriately switched by changing the position of the process unit for IR toner.

Each of the process units 6Y, 6M, 6C, 6K, and 6IR includes a photoconductor 7 serving as a latent image bearer, a charging roller 8 serving as a charger to charge the surface of the photoconductor 7, a developing device 9 to develop the latent image on the photoconductor 7, and a photoconductor cleaner 10 to clean the surface of the photoconductor 7. On a position facing each photoconductor 7, an irradiator 11 to form a latent image on the surface of the photoconductor 7 is disposed. In the present embodiment, a light emitting diode (LED) unit is used as the irradiator 11. Alternatively, the irradiator 11 may be of a laser beam scanning type using a laser diode.

The transferrer 2 includes an intermediate transfer belt 12, multiple primary transfer rollers 13, a secondary transfer roller 14, and a belt cleaner 17. The intermediate transfer belt 12 is an endless belt onto which toner images on the photoconductors 7 are transferred. The primary transfer rollers 13 primarily transfer the toner images on the photoconductors 7 onto the intermediate transfer belt 12. The secondary transfer roller 14 secondarily transfers the toner images transferred onto the intermediate transfer belt 12 onto a recording medium. The belt cleaner 17 cleans the outer peripheral surface of the intermediate transfer belt 12.

The intermediate transfer belt 12 is stretched taut with a driving roller 15 and a driven roller 16 and rotates (circulates) as the driving roller 15 rotates. Each of the primary transfer rollers 13 is disposed so as to press the intermediate transfer belt 12 against respective photoconductors 7. As a result, a primary transfer nip where an image on each photoconductor 7 is transferred onto the intermediate transfer belt 12 is formed at a contact portion between the intermediate transfer belt 12 and each photoconductor 7. On the other hand, the secondary transfer roller 14 is disposed so as to contact a portion of the intermediate transfer belt 12 which is wound around the driving roller 15. A secondary transfer nip where an image on the intermediate transfer belt 12 is transferred onto a recording medium is formed at a position where the secondary transfer roller 14 and the intermediate transfer belt 12 contact each other.

The recording medium supplier 3 includes a sheet tray 18, a feed roller 19, and a timing roller pair 20. The sheet tray 18 stores a plurality of sheets P of paper serving as recording media. The feed roller 19 feeds the sheets P, one by one, from the sheet tray 18. The timing roller pair 20 feeds the sheet P fed by the feed roller 19 to the secondary transfer nip at a predetermined timing. The recording medium may be an overhead projector (OHP) transparency, OHP film, or cloth, in addition to paper. Examples of the paper include, but are not limited to, plain paper, thick paper, postcards, envelopes, thin paper, coated paper (art paper, etc.), uneven paper such as Japanese paper, and tracing paper.

The fixer 4 includes a fixing device 21 to fix an image on the sheet P. The fixing device 21 includes a fixing roller 22 and a pressure roller 23. The fixing roller 22 is heated by a heating source such as a heater. The pressure roller 23 is in contact with the fixing roller 22 at a predetermined pressure to form a fixing nip therebetween.

The recording medium ejector 5 includes an ejection roller pair 24 and an output tray 25. The ejection roller pair 24 ejects the sheet P fed from the fixing device 21 from the printer. The sheet P ejected by the ejection roller pair 24 is stacked on the output tray 25.

The processor 30 performs an image processing on image information input from a reading device (scanner), a personal computer, or the like, and controls the entire printer.

The image formation processor 40 controls image forming operations in each unit of the printer (e.g., the image former 1, the transferrer 2, the recording medium supplier 3, the fixer 4, and the recording medium ejector 5) under the control of the processor 30.

The printer further includes a container holder 102 to detachably hold multiple toner cartridges 26Y, 26M, 26C, 26K, and 26IR each serving as a toner container for storing powdery toner used for image formation. The container holder 102 is provided with four toner container holding portions on which corresponding toner cartridges are mountable. Three of the four toner container holding portions respectively hold the three toner cartridges 26Y, 26M, and 26C containing yellow toner, magenta toner, and cyan toner, respectively. The remaining one toner container holding portion selectively holds a black toner cartridge 26K or an IR toner cartridge 26IR. FIG. 1 illustrates a state in which the IR toner cartridge 26IR, not the black toner cartridge 26K, is held by the toner container holding portion.

Each of the toner cartridges 26Y, 26M, 26C, 26K, and 26IR (hereinafter collectively "toner cartridges 26") stores a toner of the same type (having the same color) as contained in the developing device 9 of the process units 6Y, 6M, 6C, 6K, and 6IR (hereinafter collectively "process units 6"), respectively. The toner cartridges 26 corresponding to the process units 6 held by the four unit holders 105 are mounted on the four toner container holding portions of the container holder 102. When the amount of toner stored in the developing device 9 of the process unit 6 held by the unit holder 105 falls below a predetermined amount, the same type of toner is supplied to the developing device 9 from the corresponding toner cartridge 26 mounted on the toner container holding portion.

The printer further includes a waste toner container 27. The waste toner container 27 stores waste toner collected by the belt cleaner 17 and the photoconductor cleaners 10.

As illustrated in FIG. 1, the printer includes a cover 101 for opening and closing the upper portion of a main body 100 of the printer (hereinafter "apparatus body 100"). The cover 101 is revolvable upward and downward about a revolving shaft 103 disposed in the apparatus body 100. Below the cover 101, the container holder 102 for detachably holding the four toner cartridges 26 at the toner container holding portions is disposed. The container holder 102 is revolvable upward and downward about another revolving shaft 104 disposed in the apparatus body 100.

In a case in which the IR process unit 6IR is mounted on the unit holder 105 as illustrated in FIG. 1, the process units 6Y, 6M, 6C, and 6IR are disposed such that, on a recording medium, an IR toner image (special toner image) formed with IR toner is disposed closer to the recording medium than color toner images formed with Y, M, and C color toners are. Specifically, the IR process unit 6IR is arranged on the most downstream side and the color process units 6Y, 6M, and 6C are arranged on the upstream side thereof in the direction of moving of the intermediate transfer belt 12. Basically, on the intermediate transfer belt 12, a Y toner image, an M toner image, a C toner image, and an IR toner image are stacked in this order from the intermediate transfer belt 12 side. On the other hand, after the secondary transfer, the IR toner image, the C toner image, the M toner image, and the Y toner image are stacked on the recording medium in this order from the recording medium side.

Since the IR toner image is formed to be closer to the recording medium than the color toner images are, the IR toner image is concealed behind the color toner images and invisibility of the IR toner image is easily increased. The arrangement position of the IR process unit 6IR relative to the color process units 6Y, 6M, and 6C can be appropriately changed. Further, as described above, in a case in which the mounting positions of the process units 6Y, 6M, 6C, and 6IR are interchangeable with each other, the position of the IR process unit can be freely exchanged.

In the present embodiment, the printer adjusts deposition amount per unit area of each of Y, M, C, K and IR toners to adjust image density of each toner. Specifically, the printer is provided with a toner deposition amount detection sensor 60 to detect toner deposition amount in test toner images (i.e., multiple toner patches formed to have different target densities) of each of Y, M, C, K, and IR toners formed on the intermediate transfer belt 12. Based on the results detected by the toner deposition amount detection sensor 60, image forming conditions in each of the Y, M, C, K and IR process units are adjusted so that a desired amount of toner is deposited to achieve a desired density.

The toner deposition amount detection sensor 60 may be commonly used for each of the test toner images of Y, M, C, K, and IR toners, or may be individually provided for each of the test toner images of Y, M, C, K, and IR toners. In the present embodiment, the toner deposition amount detection sensor 60 is an optical image density sensor (optical sensor) to emit light to each test toner image and receives both specular reflection light and diffuse reflection light from the test toner image. With respect to color toners of Y, M, and C, the toner deposition amount in the test toner image (the image density of the test toner image) is detected based on the received amount of specular reflection light and diffuse reflection light. With respect to K toner, the toner deposition amount in the test toner image (the image density of the test toner image) is detected based only on the received amount of specular reflection light.

The IR toner of the present embodiment becomes invisible (i.e., becomes an image that is difficult to visually observe or an image substantially having no absorption peak within the visible light region) after the fixing process. However, before the fixing process, the IR toner remains visible (i.e., remains an image that is visually observable or an image substantially having an absorption peak within the visible light region) on the intermediate transfer belt 12. Therefore, the toner deposition amount detection sensor 60 used for C, M, Y and K toners can also be used for IR toner. In the present embodiment, a common deposition amount detection sensor is used for the K test toner image and the IR test toner image. In detecting toner deposition amount in the test toner image of IR toner, it is preferable to acquire both specular reflection light and diffuse reflection light, rather than acquiring only specular reflection light, for higher detection accuracy.

Next, basic operations of the printer of the present embodiment is described below.

When an image forming operation is started, each photoconductor 7 is rotationally driven, and the charging roller 8 uniformly charges the surface of each photoconductor 7 to a predetermined polarity. Next, based on image information input from a reading device (scanner), a personal computer, or the like, the irradiator 11 irradiates the charged surface of each photoconductor 7 with laser light to form a latent image (electrostatic latent image) thereon.

The latent image is formed on each photoconductor 7 based on single-color image information obtained by decomposing a target full color image into Y, M, and C color information. More specifically, color information (RGB, YCM, etc.) of the input image information is converted and decomposed into color information expressed by Y, M, and C, using a color conversion decomposition table for converting and decomposing color information of the input image information into color information (YMC) for the printer, to generate single-color image information. The irradiators 11 for Y, M, and C form respective latent images on respective photoconductors 7 based on the respective image information of Y, M, and C colors.

In a case in which the black process unit 6K is mounted, after single-color image information of Y, M, and C are generated, single-color image information in which K color information is extracted is generated and the single-color image information of Y, M, and C are corrected. This processing generates image information of K, like a processing called UCR (Under Color Removal). As a result of this processing, a black-color or gray-color image information expressed by superimposition of Y, M, and C toners is replaced with image information of K. The irradiator 11 used for K image formation (commonly used for IR image formation) forms a K latent image on the photoconductor 7 in the black process unit 6K based on the K image information.

Further, in the present embodiment, in a case in which a hardly visible image is formed based on additional information included in the input image information or added by the printer, IR image information is created from the additional information. The additional information included in the input image information may be information added by an application on a personal computer or added by a print driver on a personal computer. In a case in which the IR process unit 6IR is mounted, the irradiator 11 used for IR image formation (commonly used for K image formation) forms an IR latent image on the photoconductor 7 in the IR process unit 6IR based on the IR image information.

In a case in which the black process unit 6K is mounted, the latent images of Y, C, M, and K formed on the respective photoconductors 7 are supplied with toner from the respective developing devices 9 and developed into respective toner images of Y, C, M, and K. The toner images on the photoconductors 7 are sequentially superimposed and transferred onto the intermediate transfer belt 12 when traveling around. Specifically, upon reaching the position of the primary transfer nip, each toner image on each photoconductor 7 is sequentially transferred onto the intermediate transfer belt 12 by a transfer electric field formed due to application of a predetermined voltage to the primary transfer roller 13. Thus, a full-color toner image (visible image) composed of Y, C, M, and K toners is formed on the surface of the intermediate transfer belt 12. Residual toner particles remaining on the photoconductor 7 failed to be transferred onto the intermediate transfer belt 12 are removed by the photoconductor cleaner 10.

In a case in which the IR process unit 6IR is mounted, the latent images of Y, C, M, and IR formed on the respective photoconductors 7 are supplied with toner from the respective developing devices 9 and developed into respective toner images of Y, C, M, and IR. The toner images on the photoconductors 7 are sequentially superimposed and transferred onto the intermediate transfer belt 12 when traveling around, as described above. Thus, a full-color toner image (visible image) composed of Y, C, and M toners and an IR toner image (special toner image) composed of IR toner are formed on the surface of the intermediate transfer belt 12. Residual toner particles remaining on the photoconductor 7 failed to be transferred onto the intermediate transfer belt 12 are removed by the photoconductor cleaner 10, as described above.

On the other hand, when the image forming operation is started, the feed roller 19 starts rotating to feed the sheet P from the sheet tray 18. Conveyance of the sheet P is temporarily stopped by the timing roller pair 20. The timing roller pair 20 restarts rotating to convey the sheet P to the secondary transfer nip in synchronization with an entry of the toner images on the intermediate transfer belt 12 into the secondary transfer nip.

At the time when the sheet P is conveyed to the secondary transfer nip, the secondary transfer roller 14 is applied with a predetermined voltage so that a transfer electric field is formed in the secondary transfer nip. The toner images on the intermediate transfer belt 12 are collectively transferred onto the sheet P by the transfer electric field formed in the secondary transfer nip. At this time, toner particles remaining on the intermediate transfer belt 12 are removed by the belt cleaner 17.

The sheet P is then conveyed to the fixing device 21. The fixing roller 22 and the pressure roller 23 heat and pressurize the toner image to fix the toner image on the sheet P. The ejection roller pair 24 ejects the sheet P from the printer onto the output tray 25.

The above description refers to an image forming operation for forming a full-color image. The printer is also capable of forming an image by operating only one of the four process units 6Y, 6M, 6C, and 6IR (or 6K) or by operating two or three of the four process units.

Next, the difference between a normal operation for forming a visible image without forming an IR image (hardly visible image) and a special operation for forming both an IR image (hardly visible image) and a visible image is described below with reference to the drawings.

The following description refers to a case in which color information of the input image information is RGB multi-valued information and an IR image is formed based on IR image information (additional information) which is included in the input image information. The additional information included in the input image information needs not be image information. In the case of non-image information, the processor 30 may execute an IR image generation program to generate IR image information from the additional information. Even when no additional information is included in the input image information, the processor 30 may generate IR image information according to user designation or the like.

Figure 2:
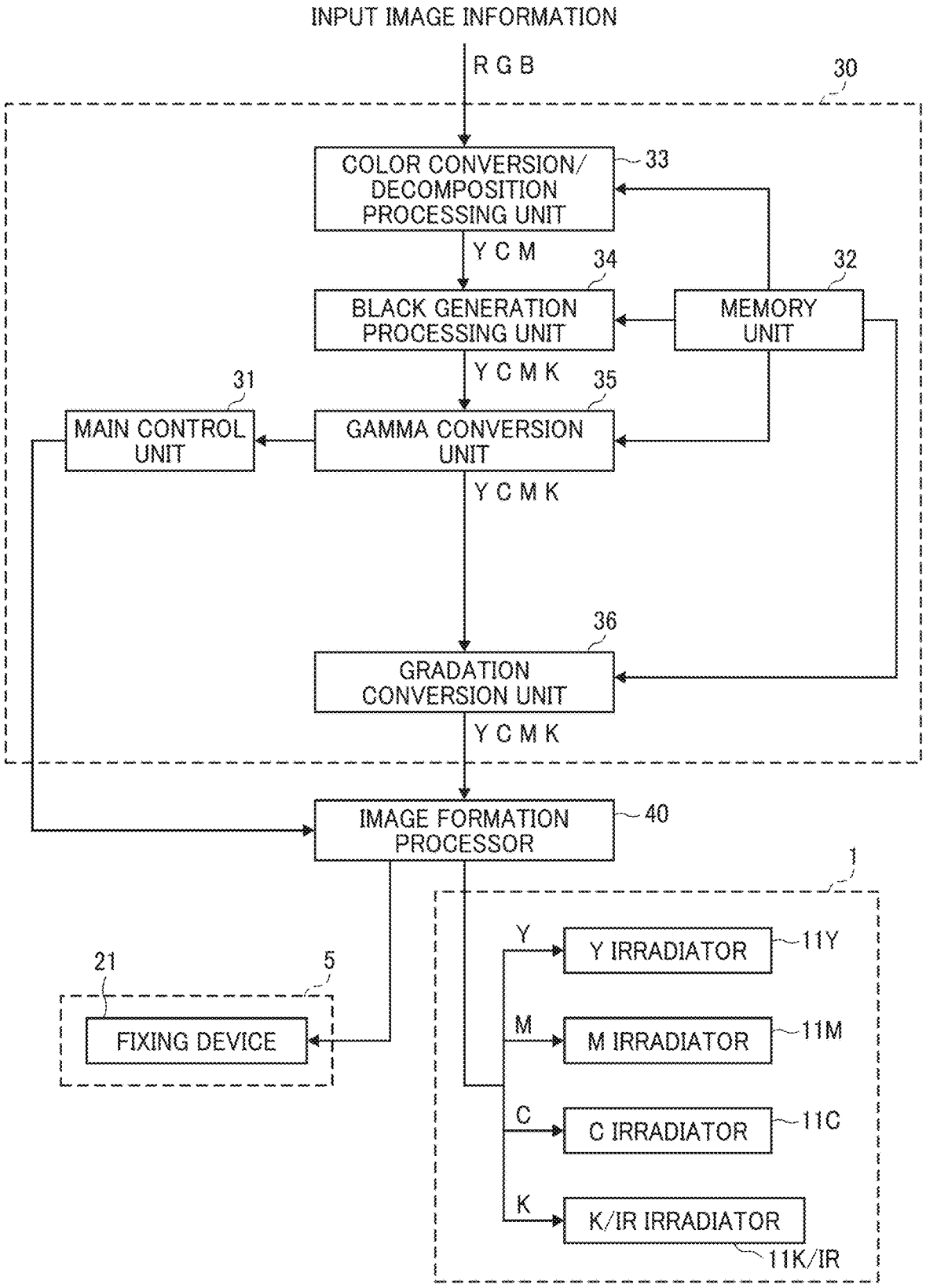
FIG. 2 is a block diagram of a normal operation according to an embodiment of the present invention.

FIG. 2 is a block diagram of the normal operation in the printer according to the present embodiment.

Figure 3:
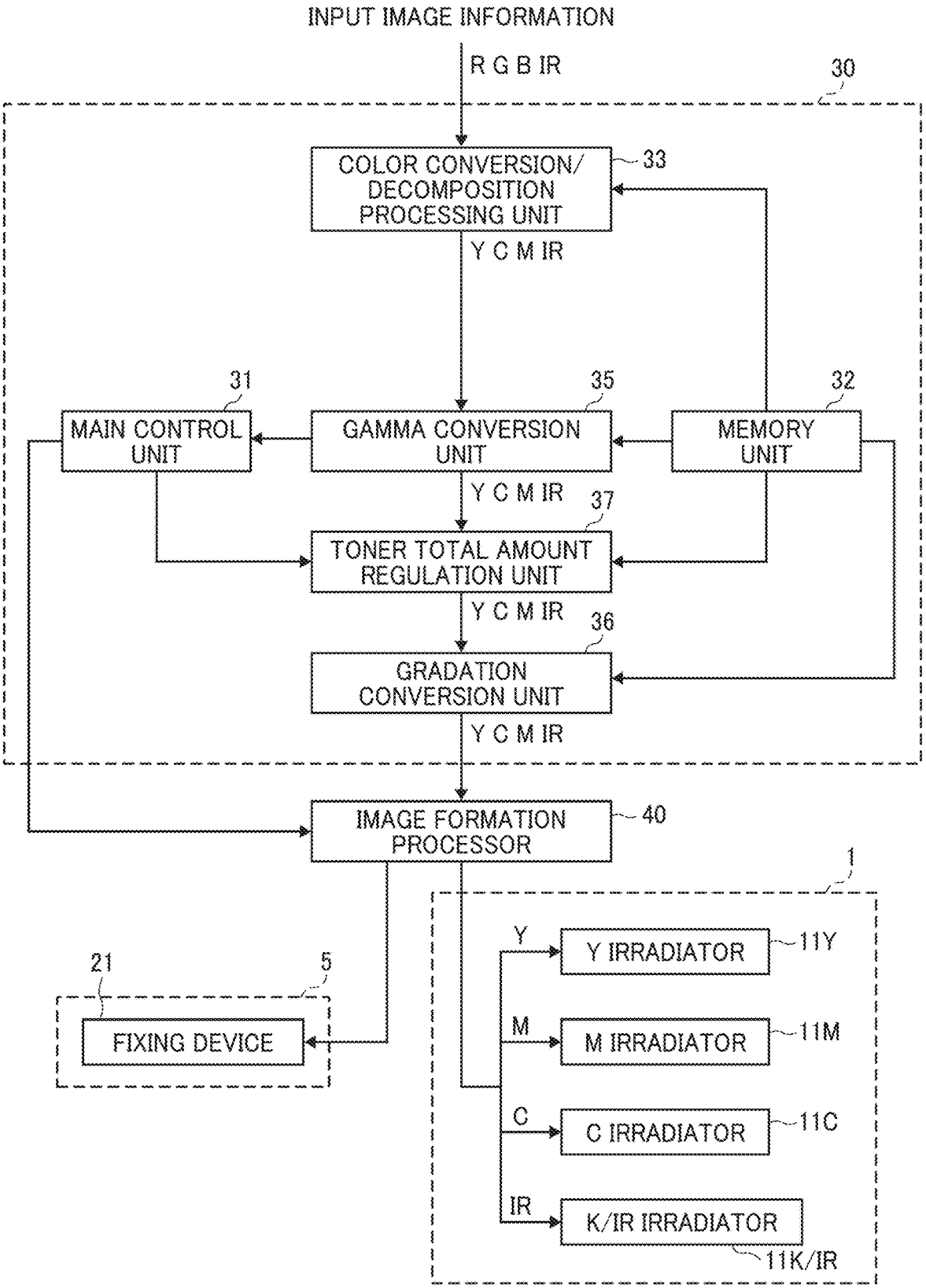
FIG. 3 is a block diagram of a special operation according to an embodiment of the present invention.

FIG. 3 is a block diagram of the special operation in the printer according to the present embodiment.

The processor 30 includes a main control unit 31, a memory unit 32, a color conversion/decomposition processing unit 33, a black generation processing unit 34, a gamma conversion unit 35, a gradation conversion unit 36, and a toner total amount regulation unit 37. It should be noted that the black generation processing unit 34 is not used in the special operation and the toner total amount regulation unit 37 is not used in the normal operation.

The main control unit 31 includes a central processing unit (CPU), a random access memory (RAM), and a read only memory (ROM), and executes various programs to perform image processing and overall control of the printer.

The memory unit 32 stores various data and programs to be used by each unit of the processor 30.

The color conversion/decomposition processing unit 33 converts and decomposes color information (RGB) of the input image information into color information of Y, M, and C for the printer, using a color conversion decomposition table stored in the memory unit 32, and generates image information of each of Y, M, and C colors. In a case in which IR image information is included in the input image information, IR image information is generated by being extracted from the input image information.

The black generation processing unit 34 is used when the black process unit 6K is mounted and the normal operation is performed. The black generation processing unit 34 generates single-color image information of K from single-color image information of Y, M, and C output from the color conversion/decomposition processing unit 33, using a black generation processing conversion table (e.g., UCR table) stored in the memory unit 32, and corrects the single-color image information of Y, M, and C. By this processing performed by the black generation processing unit 34, a black-color or gray-color image information expressed by superimposition of Y, M, and C toners is replaced with image information of K. As a result of replacing the black-color or gray-color image information expressed by three toners of Y, M, and C with image information of K, the amount of toner composing the toner image portion corresponding to the image information can be reduced.

The gamma conversion unit 35 performs a γ (gamma) conversion processing, using a gamma conversion table stored in the memory unit 32, on the image information of each of Y, M, C, and K colors, and on the IR image information if necessary, to produce an appropriate gradation on a recording medium.

The gradation conversion unit 36 performs a gradation conversion processing, using dither pattern data stored in the memory unit 32, to convert each of the Y, M, C, K, and IR image information into a dither pattern according to half tone density.

The toner total amount regulation unit 37 is used when the IR process unit 6IR is mounted and the special operation is performed. Specifically, under the control of the main control unit 31, the toner total amount regulation unit 37 performs a toner deposition amount conversion processing (image processing), using the toner deposition amount conversion table stored in the memory unit 32, on the gamma-corrected (gamma-converted) image information of each of Y, M, and C colors, so that the total amount of Y, M, C, and IR toners (hereinafter "total amount of toner") deposited per unit area becomes equal to or less than the upper limit of the amount of toner that can be fixed (hereinafter "fixable amount of toner"). At this time, the toner deposition amount conversion processing (image processing) may also be performed on the IR image information.

Figure 4:
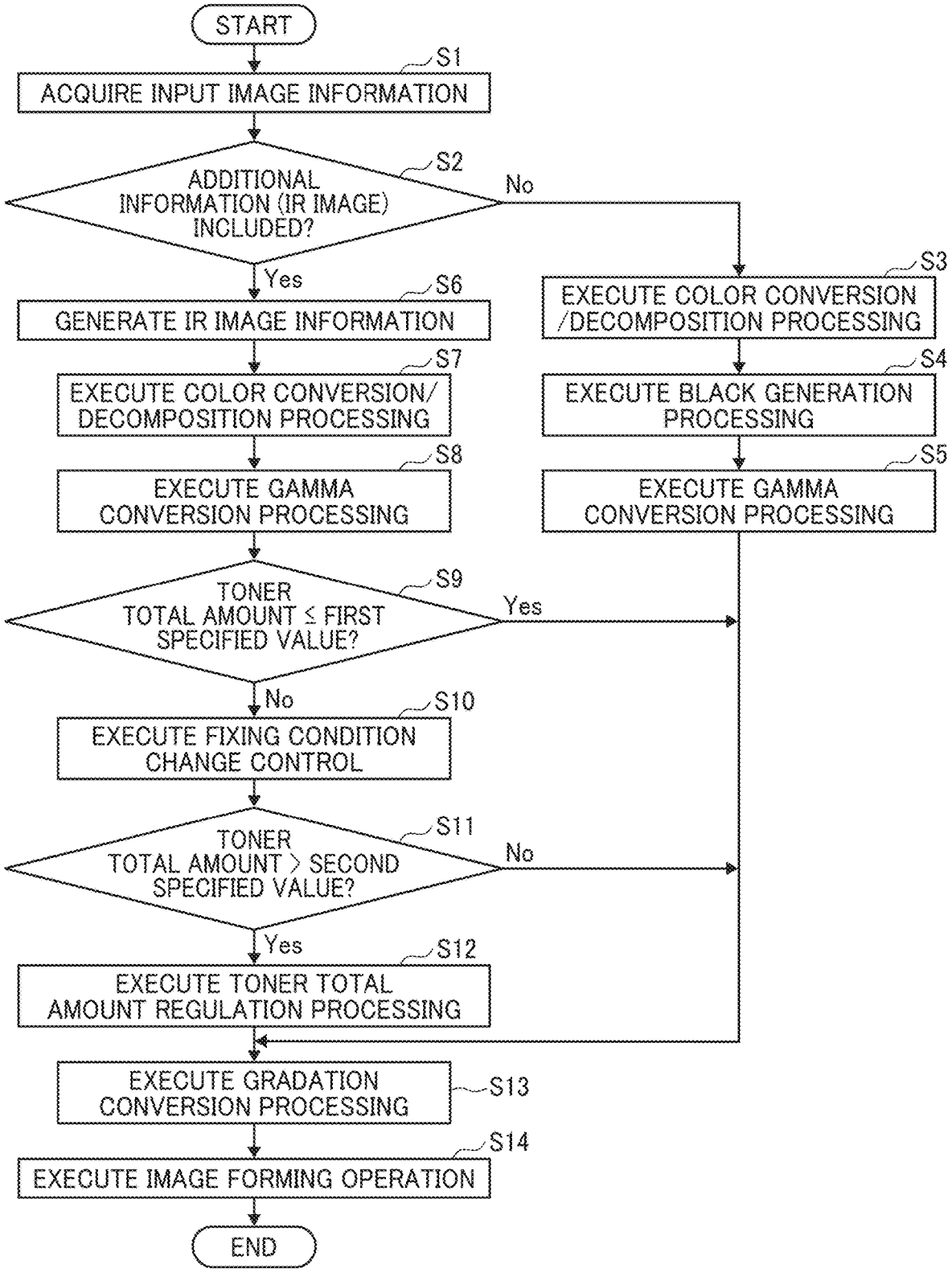
FIG. 4 is a flowchart of an image forming operation according to an embodiment of the present invention.

FIG. 4 is a flowchart of the image forming operation in the present embodiment.

First, the processor 30 acquires image information input from a reading device (scanner), a personal computer, or the like (S1), and determines whether or not to generate IR image information. Next, whether or not additional information used for generating IR image information is included in the input image information is determined (S2).

When it is determined that additional information is not included in the input image information (No in S2), the color conversion/decomposition processing unit 33 of the processor 30 converts and decomposes color information (RGB) of the input image information into color information of Y, M, and C for the printer, using a color conversion decomposition table stored in the memory unit 32 (S3). Subsequently, the black generation processing unit 34 of the processor 30 executes a black generation processing (S4) to generate color information of K from the color information of Y, M, and C, using a black generation processing conversion table (e.g., UCR table) stored in the memory unit 32, and corrects the color information of Y, M, and C. As a result, color information of black color or gray color expressed by three toners of Y, M, and C is replaced with color information of K and the amount of toner composing the toner image portion can be reduced.

With respect to the generated image information of Y, M, C, and K, the gamma conversion unit 35 executes a gamma conversion processing (S5) and the gradation conversion unit 36 executes a gradation conversion processing (S13). Each of the image information of Y, M, C, and K output from the gradation conversion unit 36 is thereafter transmitted to the image formation processor 40 and an image forming operation (normal operation) is executed (S14). The image formation processor 40 controls the irradiators 11Y, 11M, and 11C and the irradiator 11K-IR, commonly used for K and IR, based on the respective image information of Y, M, C, and K, to form respective latent images of Y, M, C, and K on the respective photoconductors 7. The image formation processor 40 controls each developing device 9 to develop each latent image with each toner to form each toner image, then controls each portion of the transferrer 2 to sequentially transfer the toner images on the intermediate transfer belt 12 and collectively transfer the toner images of Y, C, M, and K on the sheet P. The image formation processor 40 then controls the fixing device 21 to fix the toner image on the sheet P and ejects it out of the apparatus.

On the other hand, if it is determined that additional information is included in the input image information (Yes in S2), IR image information is generated based on the additional information (S6). In a case in which IR image information is included in the input image information, IR image information is generated by being extracted from the input image information. Subsequently, the color conversion/decomposition processing unit 33 of the processor 30 converts and decomposes color information (RGB) of the input image information into color information of Y, M, and C for the printer, using a color conversion decomposition table stored in the memory unit 32 (S7). With respect to the generated image information of Y, M, C, and IR, the gamma conversion unit 35 executes a gamma conversion processing (S8).

Next, the main control unit 31 of the processor 30 determines whether or not an image based on the gamma-converted image information of Y, M, C, and IR contains a toner excess portion in which the total amount of toner per unit area exceeds a first specified value that is the upper limit of the amount of color toner at the time of the normal operation (for forming an image without using the IR toner) (S9). This determination is performed only when it is determined in S2 that additional information (IR image information) is included in the input image information. That is, this determination only has to be performed during the special operation and needs not be performed during the normal operation.

FIGS. 5A to 5D are schematic diagrams illustrating toner images obtained by superimposing an IR toner image and Y, M, and C toner images with each other.

Figure 5A:
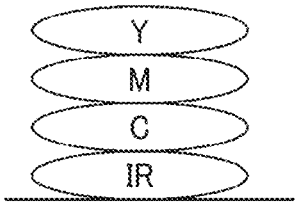
FIGS. 5A to 5D are schematic diagrams illustrating toner images obtained by superimposing an IR toner image and yellow (Y), magenta (M), and cyan (C) toner images with each other.
Figure 5B:
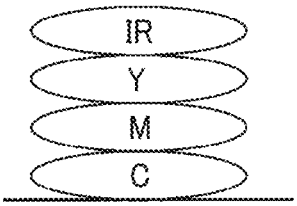
Figure 5C:
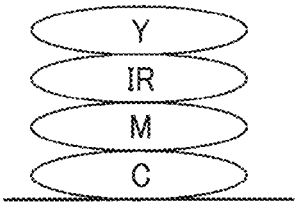
Figure 5D:
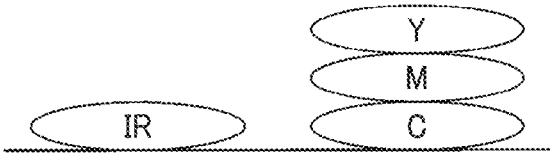

As illustrated in FIG. 5A, all the Y, M, and C toner images may be superimposed on the IR toner image. However, the resulting toner image is not limited to this configuration. For example, as illustrated in FIG. 5B, the IR toner image may be superimposed on the Y, M, and C toner images. Alternatively, as illustrated in FIG. 5C, the IR toner image may be sandwiched between the Y, M, and C toner images in a superimposed manner. In superimposing the IR toner image and the Y, M, and C toner images with each other, it is not necessary that the Y, M, and C toners are placed on the IR toner and, as illustrated in FIG. 5D, the Y, M, and C toners may be located at positions out of alignment with the IR toner. Method of superimposition may be appropriately selected by changing the arrangement order of the process units 6Y, 6M, 6C, and 6IR. Although IR toner is taken as an example in the above description, other types of special toner such as white toner can also be used.

The first specified value for the total amount of toner per unit area may be set to 220% of the toner deposition amount of each color toner, when the target toner deposition amount in forming a single-color solid image is 100%. In the normal operation during which the black process unit 6K is mounted, due to the color conversion/decomposition processing (S3) and the black generation processing (S4), the total amount of toner per unit area becomes equal to or less than the first specified value (e.g., 220%) when generating color information of Y, M, C, and K for the printer from color information (RGB) of the input image information.

On the other hand, in the special operation during which the IR process unit 6IR is mounted, black-color and/or gray-color image portions (which can be replaced with color information of K in the normal operation) are formed by superimposing toner images of Y, M, and C since the black process unit 6K is not mounted. Therefore, the total amount of toner per unit area in such image portion during the special operation, is relatively larger than that used in the normal operation, which uses K toner.

In the present embodiment, invisibility of a hardly visible image formed of the IR toner image is increased by covering the IR toner image with the Y, M, and C toner image portions in which the total amount of toner is large. However, if the total amount of toner per unit area is excessively large, specifically, if the total amount of toner per unit area exceeds first specified value (for example, 220%), defective fixing may be caused. Therefore, when it is determined that additional information is included in the input image information (i.e., in the special operation), the main control unit 31 determines whether or not it is determined that the toner excess portion in which the total amount of toner per unit area exceeds the first specified value is included (S9).

When it is determined that the toner excess portion in which the total amount of toner per unit area exceeds the first specified value is included (No in S9), a fixing condition change control is executed (S10). More specifically, the main control unit 31 outputs a control command to the image formation processor 40 to increase the fixing ability of the fixing device 21 or to lengthen the fixing processing time by the fixing device 21, or both, than those at the time of the normal operation. On the other hand, when it is determined that the toner excess portion in which the total amount of toner per unit area exceeds the first specified value is not included (Yes in S9), an image forming operation is executed under the same fixing condition as the normal operation.

The fixing ability of the fixing device 21 may be increased by, for example, increasing the fixing temperature or the fixing nip pressure. The fixing processing time by the fixing device 21 may be lengthened by, for example, lowering the conveying speed of the sheet P passing through the fixing device 21.

By changing the fixing conditions as described above, in the special operation for creating IR image in addition to Y, M, and C images, the Y, M, C, and IR toner images can be fixed on the sheet P without causing fixing defect by merely passing the sheet P through the fixing device 21 one time, even when there is a toner excess portion in which the amount of toner exceeds the upper limit of the amount of color toner during the normal operation.

However, if the fixing ability of the fixing device 21 is excessively increased or the fixing processing time by the fixing device 21 is excessively lengthened, the fixing processing becomes excessive for portions other than the toner excess portion, possibly causing unacceptable image quality deterioration. Further, when the total amount of toner becomes equal to or greater than a certain value, sufficient fixing may not be achieved by simply changing the fixing conditions. Specifically, when the total amount of toner per unit area exceeds a second specified value (for example, 300%), it is impossible to solve these problems by merely changing the fixing condition.

Therefore, in the present embodiment, the main control unit 31 determines whether or not an image based on the gamma-converted image information of Y, M, C, and IR contains an unfixable portion in which the total amount of toner per unit area exceeds the second specified value (e.g., 300%) that is the upper limit of the amount of toner fixable by one time of fixing processing (S11). This determination is also performed only when it is determined in S2 that additional information (IR image information) is included in the input image information. That is, this determination only has to be performed during the special operation and needs not be performed during the normal operation.

When it is determined that the unfixable portion in which the total amount of toner per unit area exceeds the second specified value is included (Yes in S11), the main control unit 31 causes the toner total amount regulation unit 37 to execute a toner total amount regulation processing (image processing) (S12). In the toner total amount regulation processing according to the present embodiment, at the time of the special operation in which K toner is not used, a toner deposition amount conversion processing (image processing) is performed on each of Y, M, and C image information to reduce the amount of color toner per unit area than that in the normal operation in which K toner is used to form the same visible image.

In the toner total amount regulation processing, the gamma-corrected (gamma-converted) image information of each of Y, M, and C colors output from the gamma conversion unit 35 are converted, using the toner deposition amount conversion table stored in the memory unit 32, so as to reduce the toner deposition amount per unit area in each of Y, M, and C toner images and generate image information of each of Y, M, and C colors including no unfixable portion in which the total amount of toner per unit exceeds the second specified value.

Such a toner total amount regulation processing makes it possible to prevent that merely changing the fixing conditions makes the fixing process excessive or insufficient through one time of the fixing process.

The toner total amount regulation processing is not particularly limited as long as at least the total amount of toner at the unfixable portion can be reduced to a value not more than the second specified value that is the upper limit of the fixable amount of toner.

Therefore, it may be possible to execute a processing which converts a part of image information (corresponding only to the unfixable portion) such that the total amount of toner at the unfixable portion is reduced to a value not more than the second specified value that is the upper limit of the fixable amount of toner, so that the total amount of toner is reduced to a value not more than the second specified value only at the unfixable portion while the total amount of toner is maintained at the portion other than the unfixable portion.

In the present embodiment, when it is determined that additional information (IR image information) is not included in the input image information (No in S2), that is, at the time of the normal operation, color information of Y, M, C, and K are generated from color information (RGB) of the input image information (S3, S4), followed by the gamma conversion processing (S5) and the gradation conversion processing executed by the gradation conversion unit 36 (S13). Each of the image information of Y, M, C, and K output from the gradation conversion unit 36 is thereafter transmitted to the image formation processor 40 and an image forming operation is executed under the normal fixing condition (S14).

On the other hand, when it is determined that additional information (IR image information) is included in the input image information (Yes in S2), that is, at the time of the special operation, a toner amount increase control is executed to increase the amount of color toner forming the visible image than that in the normal operation. That is, in the normal operation during which the black process unit 6K is mounted, a black-color or gray-color image information expressed by superimposition of Y, M, and C toners is replaced with image information of K and the total amount of Y, M, and C toners in that toner image portion becomes small. On the other hand, in the special operation during which the IR process unit 6IR is mounted, the black-color or gray-color image information is not replaced with image information of K and that image portion is formed by superimposing Y, M, and C toners. Therefore, the total amount of Y, M, and C toners per unit area in that toner image portion becomes larger than that in the normal operation. As a result, in the special operation during which the IR process unit 6IR is mounted, the IR toner image is covered with Y, M, and C toner image portions in which the total amount of toner is large, thereby increasing invisibility of a hardly visible image formed of the IR toner image.

According to the present embodiment, in the special operation, when the toner excess portion in which the total amount of toner per unit area exceeds the first specified value and not exceeds the second specified value is included (No in S9, No in S11), the fixing condition change control is executed (S10) so as to suppress defective fixing even in one time of fixing processing.

Furthermore, according to the present embodiment, in the special image forming operation, when the unfixable portion in which the total amount of toner per unit area exceeds both the first specified value and the second specified value is included (No in S9, Yes in S11), both the fixing condition change control (S10) and the toner total amount regulation processing (S12) are executed so as to suppress defective fixing in one time of fixing processing even in a situation where merely changing the fixing condition does not suppress defective fixing.

In the present embodiment, as described above, when the IR image is further superimposed on the black image portion, the total amount of toner per unit area exceeds the second specified value (e.g., 300%) in that portion, and the toner total amount regulation processing is executed. Therefore, in the printer of the present embodiment, the image density of a black image formed by superimposing an IR toner image on Y, M, and C color toner images is lower than that of a black image formed only with Y, M, and C color toner images.

In the present embodiment, at the time of the special operation, only the fixing condition change control is executed according to the total toner amount, or both the fixing condition change control and the toner total amount regulation processing as the toner amount suppression control are executed. It is also possible that only the toner total amount regulation processing is executed without executing the fixing condition change control.

With respect to color conversion data for converting color information of the input image information into color information for the printer in the present embodiment, the color conversion decomposition table stored in the memory unit 32 is used as normal color conversion data at the time of the normal operation, and the color conversion decomposition table stored in the memory unit 32 are used as special color conversion data at the time of the special operation.

In the present embodiment, whether or not to execute the fixing condition change control or the toner total amount regulation processing is determined depending on whether or not the total amount of toner exceeds the first specified value or the second specified value. However, the condition for determining whether or not to execute the fixing condition change control or the toner total amount regulation processing is not limited thereto. For example, the process can be simplified if the fixing condition change control and the toner total amount regulation processing are always executed when it is determined that the additional information (IR image information) is included in the input image information.

Figure 6:
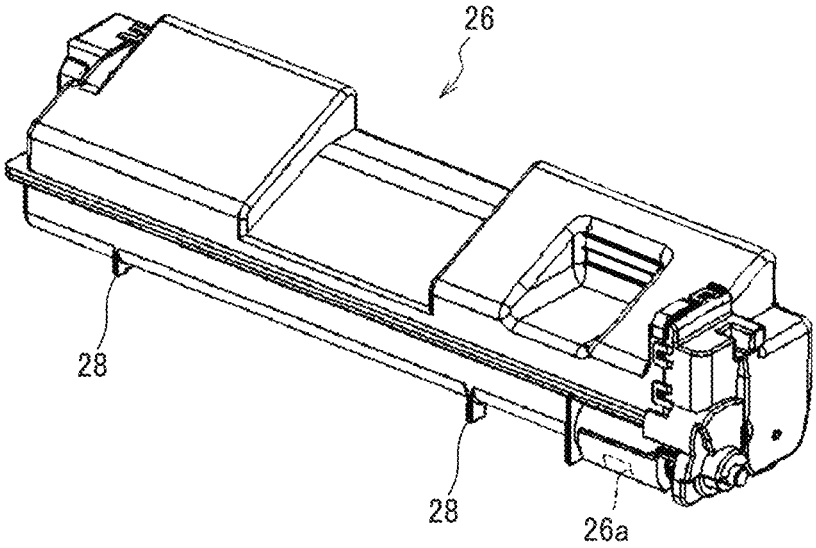
FIG. 6 is a perspective view of a toner cartridge according to an embodiment of the present invention.

FIG. 6 is a perspective view of the toner cartridge 26.

Each of the toner cartridges 26Y, 26M, 26C, 26K, and 26IR has the same basic configuration except that the type of toner stored therein is different. Each of the toner cartridges 26Y, 26M, 26C, 26K, and 26IR stores toner therein and discharges the toner from a toner discharge port 26*a*.

In the present embodiment, the toner cartridge 26 is configured not to be mounted on the process unit 6 which is held by the unit holder 105 of the printer main body but does not correspond to the toner cartridge 26. Specifically, the developing device of the black process unit 6K has a connecting portion having a shape engageable with a connecting portion 28 of the black toner cartridge 26K but not engageable with a connecting portion 28 of the IR toner cartridge 26IR. Similarly, the developing device of the IR process unit 6IR has a connecting portion having a shape engageable with a connecting portion 28 of the IR toner cartridge 26IR but not engageable with a connecting portion 28 of the black toner cartridge 26K.

Figure 7:
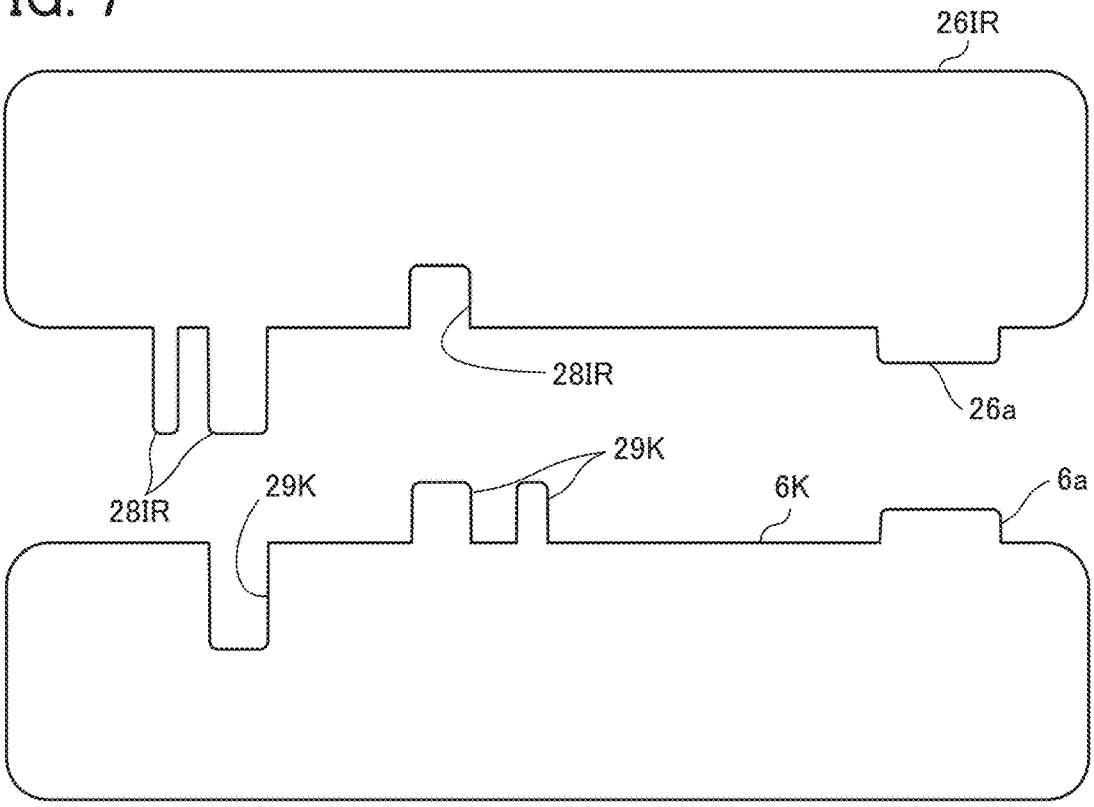
FIG. 7 is an illustration for explaining an example in which a black process unit is mounted on a unit holder of the main body of the image forming apparatus and an IR toner cartridge is mounted on the corresponding container holder.

FIG. 7 is an illustration for explaining an example in which the black process unit 6K is mounted on the unit holder 105 of the printer main body and the IR toner cartridge 26IR is mounted on the corresponding container holder 102.

In this example, a connecting portion 29K of the developing device of the black process unit 6K has a shape not engageable with a connecting portion 28IR of the IR toner cartridge 26IR. Therefore, the developing device and the IR toner cartridge 26IR do not engage with each other. Specifically, the connecting portion 28IR of the IR toner cartridge 26IR has no recess corresponding to a part of projections provided in the connecting portion 29K of the developing device of the black process unit 6K. In addition, the connecting portion 29K of the black process unit 6K has no recess corresponding to a part of projections provided in the connecting portion 281R of the IR toner cartridge 26IR. Therefore, the part of the projections strikes against the wall surface of the other side, prohibiting the IR toner cartridge 26IR from being mounted on the container holder 102. Thus, it is impossible to mount the IR toner cartridge 26IR on the black process unit 6K.

Figure 8:
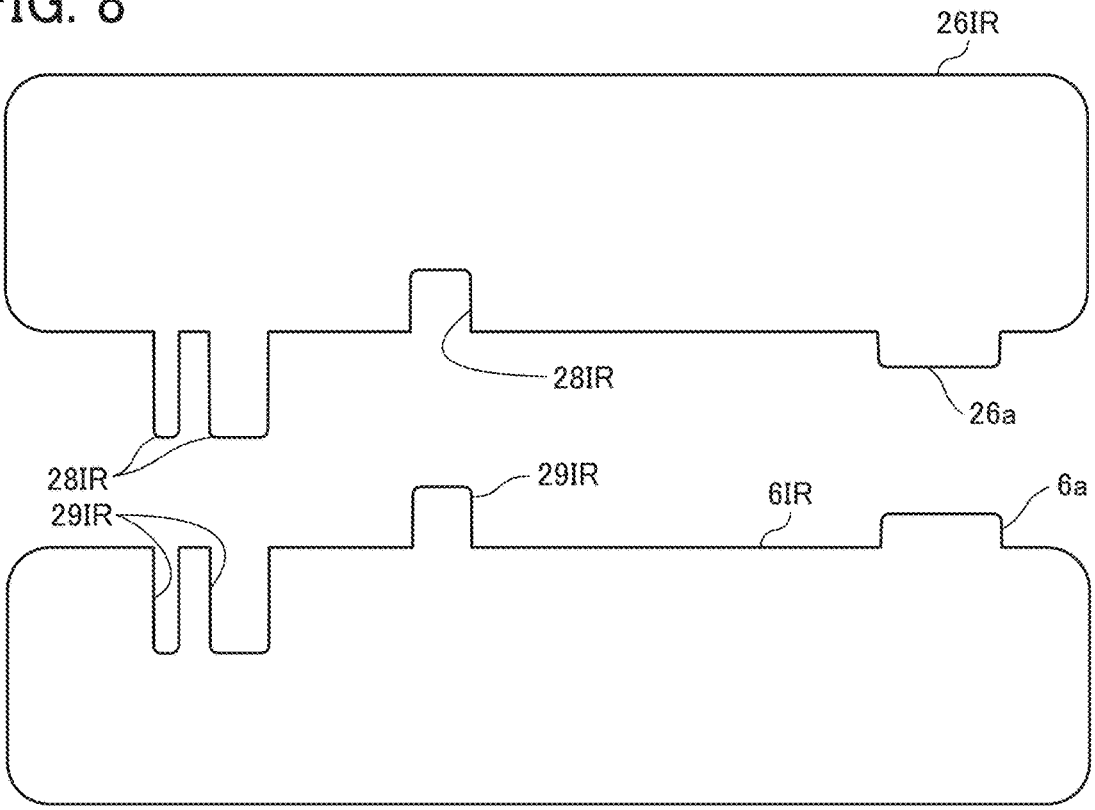
FIG. 8 is an illustration for explaining an example in which an IR process unit is mounted on a unit holder of the main body of the image forming apparatus and an IR toner cartridge is mounted on the corresponding container holder.

FIG. 8 is an illustration for explaining an example in which the IR process unit 6IR is mounted on the unit holder 105 of the printer main body and the IR toner cartridge 26IR is mounted on the corresponding container holder 102.

In this example, a connecting portion 291R of the developing device of the IR process unit 6IR has a shape engageable with the connecting portion 28IR of the IR toner cartridge 26IR. Therefore, the developing device and the IR toner cartridge 26IR are able to engage with each other. Therefore, it is possible to mount the IR toner cartridge 26IR on the container holder 102, thereby mounting the IR toner cartridge 26IR on the IR process unit 6IR. Specifically, the toner discharge port 26*a* of the IR toner cartridge 26IR is connected to a toner receiving port 6*a* of the developing device of the IR process unit 6IR, enabling toner supply.

Figure 9:
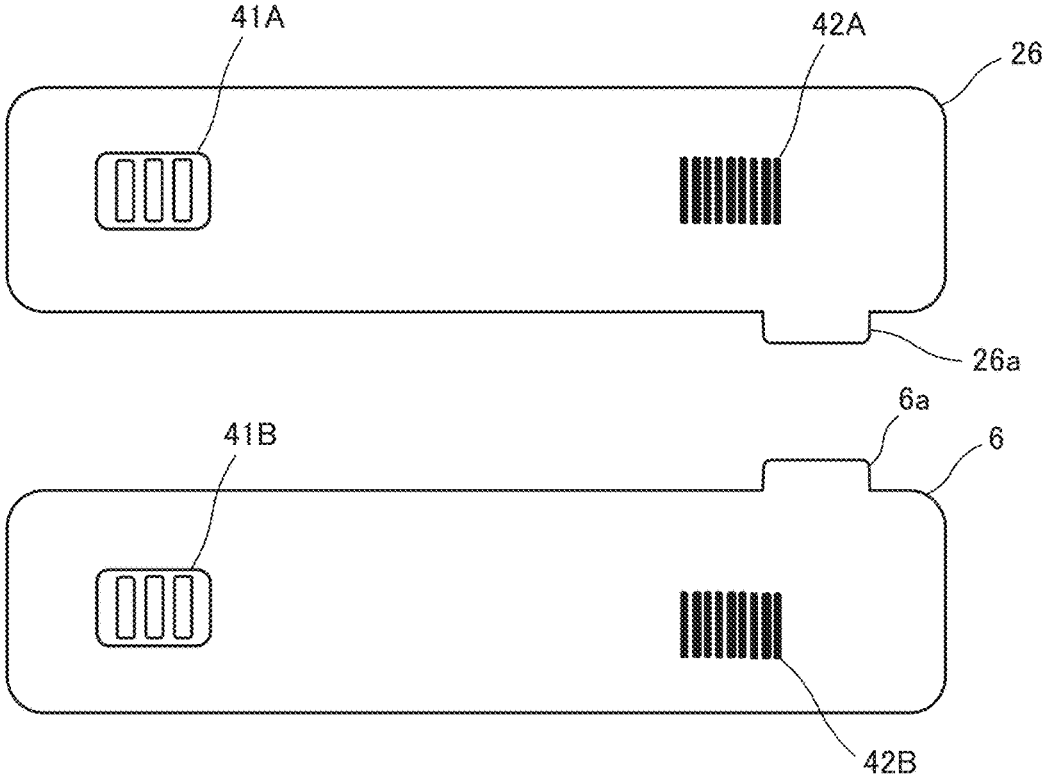
FIG. 9 is an illustration of a process unit and a toner cartridge each having an information recording portion containing identification information for identifying the type of process unit held by the unit holder and the type of toner cartridge held by the container holder.

FIG. 9 is an illustration of the process unit 6 and the toner cartridge 26 each having an information recording portion containing identification information for identifying the type of the process unit 6 (type of toner) held by the unit holder 105 and the type of the toner cartridge 26 (type of toner) held by the container holder 102.

Figure 10:
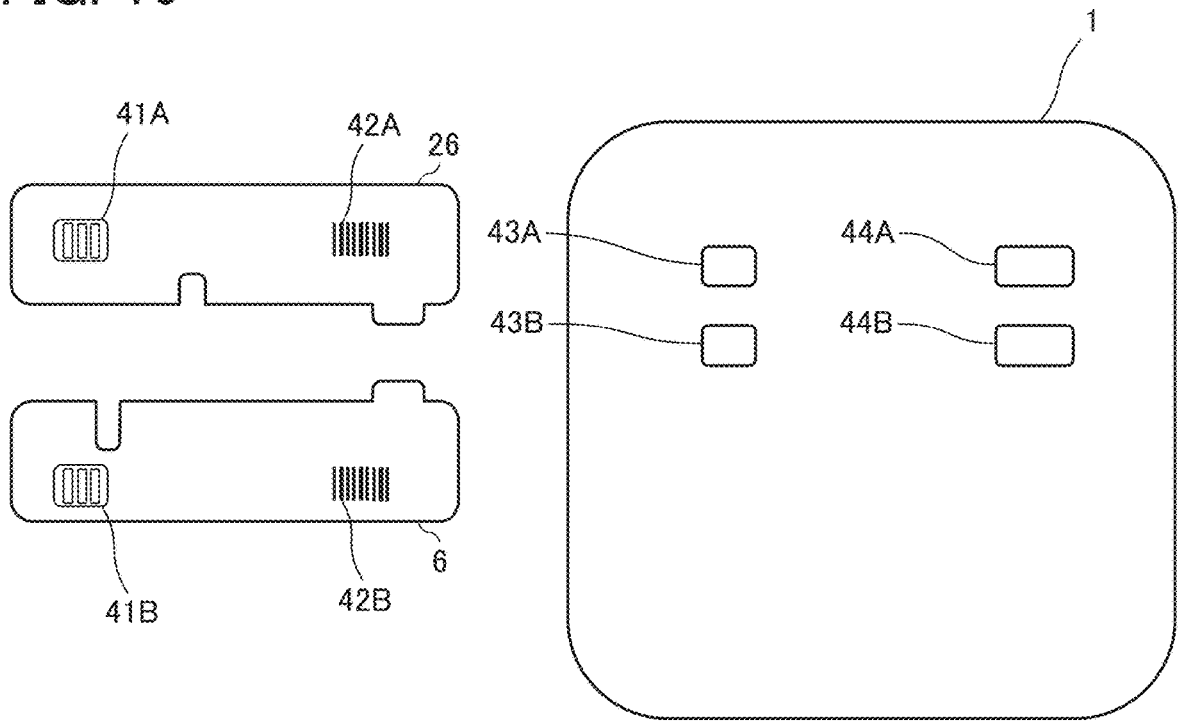
FIG. 10 is an illustration of ID chip readers and barcode readers provided in the main body of the image forming apparatus.

As illustrated in FIG. 9, ID chips 41A and 41B and barcode images 42A and 42B, which are code images encoding identification information, are available as the information recording portions. As illustrated in FIG. 10, the printer main body is provided with ID chip readers 43A and 43B and barcode readers 44A and 44B serving as information readers that read identification information from the ID chips 41A and 41B and the barcode images 42A and 42B, respectively, on the process unit 6 and the toner cartridge 26.

The ID chip reader 43A reads identification information from the ID chip 41A on the toner cartridge 26 held by the container holder 102 and sends that identification information to the processor 30. The ID chip reader 43B reads identification information from the ID chip 41B on the process unit 6 held by the unit holder 105 and sends that identification information to the processor 30. The barcode reader 44A reads identification information from the barcode image 42A on the toner cartridge 26 held by the container holder 102 and sends that identification information to the processor 30. The barcode reader 44B reads identification information from the barcode image 42B on the process unit 6 held by the unit holder 105 and sends that identification information to the processor 30.

Based on the sent identification information, the processor 30 determines the type of toner used in the toner cartridge 26 held by the container holder 102 and the type of toner used in the process unit 6 held by the unit holder 105. Based on these determination results, the processor 30 determines whether or not the toner cartridge 26 held by the container holder 102 and the process unit 6 held by the corresponding unit holder 105 use the same toner. When it is determined that the same toner is not used, the toner supply operation from the toner cartridge 26 to the developing device of the process unit 6 is prohibited.

As a result, even when the toner cartridge 26 which does not correspond to the process unit 6 mounted on the unit holder 105 of the printer main body is mounted on the container holder 102, the occurrence of toner color mixing is prevented, which is caused when the developing device of the process unit 6 is supplied with toner different from the toner used in the developing device.

The method of determining the type of the process unit 6 (type of toner) held by the unit holder 105 and the type of the toner cartridge 26 (type of toner) held by the container holder 102 is not limited to the above-described method. For example, the information recording portion provided in the process unit 6 and the toner cartridge 26 may be a mechanical key having an outer shape corresponding to the identification information. In this case, a key reader to read identification information from the mechanical key may be provided on the printer main body to obtain similar results.

Furthermore, the method of determining is not limited to reading identification information from the information recording portion provided in the process unit 6 and the toner cartridge 26. For example, the determination may be made based on the content input by the user through an operation panel 50, serving as an operation device provided in the printer main body, with respect to the type of the process unit 6 held by the unit holder 105 and the type of the toner cartridge 26 held by the container holder 102.

The determination may also be made based on a detection result by an optical image density sensor to detect a test toner image, which is formed, when a new (another) process unit 6 is mounted on the unit holder 105, using the process unit 6 under the control of the processor 30.

In the image forming apparatus according to the present embodiment, a one-dimensional code (bar code) is printed with normal granularity (106 lines/inch) when using IR toner. This is because the accuracy of reading one-dimensional codes becomes higher as the granularity thereof lowers. In particular, a solid image is used in general. In an actual behavior, in a mode for printing a one-dimensional code, a solid image is created at a screen ruling of 106 lines/inch, and in a mode (IR mode) for printing a figure (e.g., characters and symbols) which is not a one-dimensional code is created at a screen ruling of 30 lines/inch and an image area ratio of 5%.

Even in the IR mode, the image area ratio and granularity can be changed. Thus, the difficulty in viewing and the granularity can be adjusted or switched as necessary. For example, in a case in which it is more desirable to improve the degree of difficulty even if the granularity is lowered, it is preferable that the operator or the like can make adjustment or switching so as to lower the image area ratio to increase the granularity.

Visibility is changed according to superimposition of colors. For example, in the case of executing the IR mode only with IR toner, an IR toner image is formed with a screen ruling of 30 lines/inch and an image area ratio of 5%. As another example, in the case of superimposing two colors, an IR toner image is formed with a screen ruling of 10 lines/inch and an image area ratio of 5%. That is, an IR toner single color mode and a color superimposition mode exist. Superimposition of colors increases the difficulty in viewing. Therefore, when there is a large number of colors to be superimposed, the image area ratio of the IR image is maintained or lowered to increase granularity compared to a case in which there is a small number of colors to be superimposed.

Further, the image forming apparatus according to the present embodiment is set so as to print a normal color toner image with a preset screen ruling (default setting value) and to lower the screen ruling (by changing the granularity, spatial frequency, and number of isolated dots) when printing with IR toner. More specifically, in a color toner mode (first mode) in which only color toner is used for printing, a preset screen ruling is available. In an invisible toner mode (second mode) in which IR toner is used to lower visibility, a lowered screen ruling is available.

In the second mode for lowering visibility, the image area ratio is at least lower than that of the solid image. In the second mode for lowering visibility, both the image area ratio and the screen ruling are preset as default values. Alternatively, either one or both of which can be made changeable by the operator or the like. In this case, in the second mode for lowering visibility, it is preferable that the image area ratio is set to 50% or less and the screen ruling is set to 40 lines/inch or less as defaults. The image area ratio is set smaller than that of solid images.

Figure 11:
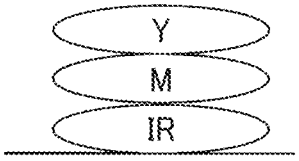
FIG. 11 is a schematic diagram illustrating a toner image in which two color toner images of yellow (Y) and magenta (M) are superimposed on an IR toner image.

The present embodiment has been described with reference to a case in which three color toner images of Y, M, and C are superimposed on an IR toner image, but is not limited to that case. For example, invisibility of the IR toner image that is a hardly visible image can be increased even in a case in which two of the three color toner images of Y, M, and C are imposed on the IR toner image. FIG. 11 is a schematic diagram illustrating a case in which two color toner images of Y and M are superimposed on an IR toner image. It is also possible that two color toner images of M and C are superimposed on an IR toner image, or two color toner images of C and Y are superimposed on an IR toner image.

Further, invisibility of the IR toner image may be increased by the following method.

Figure 12:
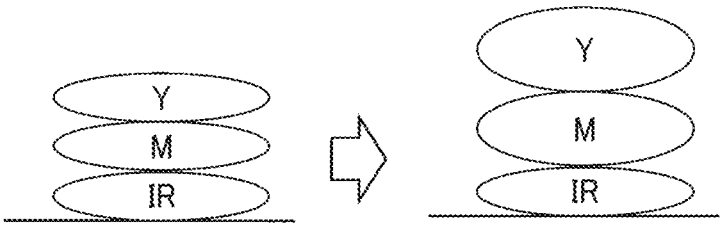
FIG. 12 is a schematic diagram illustrating a toner image in which two color toner images of yellow (Y) and magenta (M) are superimposed on an IR toner image, where the deposition amount of toner in the Y and M toner images is increased.

FIG. 12 is a schematic diagram illustrating a case in which two color toner images of Y and M are superimposed on an IR toner image, where the deposition amount per unit area of each of Y and M toners superimposed on the IR toner image is increased from 100% to 120%. By increasing the deposition amount of toner in the toner image superimposed on the IR toner image, the amount of toner covering the underlying IR toner image is increased, thus enhancing invisibility of the IR toner image.

In the case illustrated in FIG. 12, the deposition amounts of both Y and M toners are increased from 100% to 120%. Even when the deposition amount of only one of Y and M toners is increased from 100% to 120%, invisibility of the IR toner image can be enhanced.

Figure 13:
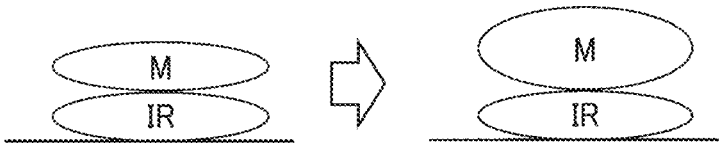
FIG. 13 is a schematic diagram illustrating a toner image in which single color toner image of magenta (M) is superimposed on an IR toner image, where the deposition amount of toner in the M toner images is increased.

FIG. 13 is a schematic diagram illustrating a case in which an M toner image, which is one of the three color toner images of Y, M, and C, is superimposed on an IR toner image, where the deposition amount per unit area of M toner is increased from 100% to 120%. Even in a case in which only one color toner image is superimposed on the IR toner image, by increasing the deposition amount of toner in the toner image superimposed on the IR toner image, the amount of toner covering the underlying IR toner image is increased, thus enhancing invisibility of the IR toner image. FIG. 13 is a schematic diagram illustrating a case in which an M toner image is superimposed on an IR toner image. It is also possible that a C toner image or a Y toner image is superimposed on an IR toner image.

The deposition amount of toner in the toner image superimposed on the IR toner image is increased within a range that does not affect the image quality. The range is appropriately determined according to the performance of the apparatus, the environment, the usage situation, etc.

Next, the toners used in the present embodiment are described in detail below.

The toner set used in the present embodiment includes Y, M, and C color toners and an IR toner as a special toner.

Each of the Y, M, and C color toners contains a binder resin and a colorant, and further contains other components as necessary. K toner also contains a binder resin and a colorant, and further contains other components as necessary.

The IR toner contains a binder resin and a near-infrared absorbing material, and further contains other components as necessary.

In the present embodiment, when a color toner image and an IR toner image (invisible toner image) are formed on the surface of a recording medium with a toner set that meets the following first or second preferred condition, the color toner image provides excellent visibility and the IR toner image provides highly-accurate readability when the color toner image is visually observed. First Condition: The toner set includes a color toner and an IR toner, and a 60-degree gloss value of a solid image of the IR toner is 30 or more and is 10 degrees or more higher than a 60-degree gloss value of a solid image of the color toner. Second Condition: The toner set includes a color toner and an IR toner, and a loss tangent (tan δi) of the IR toner is 2.5 or more at 100° C. to 140° C., and a loss tangent (tan δc) of the color toner is 2 or less at 100° C. to 140° C.

In recent years, there is an increasing demand for electrophotography to output relatively-low-gloss images to be differentiated from offset printing that outputs high-gloss images. Therefore, when the color toner has a high gloss, not only the secondary color or the tertiary color but also a portion where an invisible image (IR image) is superimposed, that is, a portion where a large amount of toner is deposited, has a high gloss, thereby causing a problem that the position of the IR image can be visually recognizable. Furthermore, in a case in which a color toner image is formed on an IR image, the superimposed color toner easily enters the IR toner layer when being heated and pressurized in the fixing nip, so that accuracy in reading information of the IR image by a machine becomes unstable.

IR Toner

The IR toner contains a binder resin and a near-infrared absorbing material, and further contains other components as necessary.

Binder Resin

The binder resin is not particularly limited, and any of conventionally known resins can be used. Examples of the binder resin include, but are not limited to, styrene-based resins such as styrene, α-methylstyrene, chlorostyrene, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, and styrene-acrylonitrile-acrylate copolymer, polyester resins, vinyl chloride resins, rosin-modified maleic acid resins, phenol resins, epoxy resins, polyethylene resins, polypropylene resins, ionomer resins, polyurethane resins, silicone resins, ketone resins, xylene resins, petroleum resins, and hydrogenated petroleum resins. Each of these materials can be used alone or in combination with others. Among these materials, styrene-based resins containing aromatic compounds as constitutional units and polyester resins are preferable, and polyester resins are more preferable.

The polyester resin may be obtained by a polycondensation reaction between commonly known alcohols and acids.

Specific examples of the alcohols include, but are not limited to: diols such as polyethylene glycol, diethylene glycol, triethylene glycol, 1,2-propylene glycol, 1,3-propylene glycol, 1,4-propylene glycol, neopentyl glycol, and 1,4-butenediol; etherified bisphenols such as 1,4-bis(hydroxymethyl)cyclohexane, bisphenol A, hydrogenated bisphenol A, polyoxyethylenated bisphenol A, and polyoxypropylenated bisphenol A; divalent alcohol monomers obtained by substituting the above compounds with a saturated or unsaturated hydrocarbon group having 3 to 22 carbon atoms; other divalent alcohol monomers; and alcohol monomers having 3 or higher valences such as sorbitol, 1,2,3,6-hexanetetraol, 1,4-sorbitan, pentaerythritol, dipentaerythritol, tripentaerythritol, sucrose, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene. Each of these materials can be used alone or in combination with others.

The acids are not particularly limited and may be appropriately selected according to the purpose, but carboxylic acids are preferable.

Specific examples of the carboxylic acids include, but are not limited to: monocarboxylic acids such as palmitic acid, stearic acid, and oleic acid; maleic acid, fumaric acid, mesaconic acid, citraconic acid, terephthalic acid, cyclohexanedicarboxylic acid, succinic acid, adipic acid, sebacic acid, and malonic acid, and divalent organic acid monomers obtained by substituting these acids with a saturated or unsaturated hydrocarbon group having 3 to 22 carbon atoms; anhydrides of these acids; dimers of lower alkyl esters and linolenic acid; 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, and enpol trimer acid; and polyvalent carboxylic acid monomers having 3 or more valences such as anhydrides of the above acids. Each of these materials can be used alone or in combination with others.

The binder resin may contain a crystalline resin.

The crystalline resin is not particularly limited as long as it has crystallinity and can be appropriately selected according to the purpose. Examples of the crystalline resin include, but are not limited to, polyester resins, polyurethane resins, polyurea resins, polyamide resins, polyether resins, vinyl resins, and modified crystalline resins. Each of these materials can be used alone or in combination with others. Among these materials, polyester resins, polyurethane resins, polyurea resins, polyamide resins, and polyether resins are preferable. In particular, resins having at least one of a urethane backbone and a urea backbone are preferable for imparting moisture resistance and incompatibility with an amorphous resin (to be described later).

The crystalline resin preferably has a weight average molecular weight (Mw) of from 2,000 to 100,000, more preferably from 5,000 to 60,000, and most preferably from 8,000 to 30,000, for fixability. When the weight average molecular weight is 2,000 or more, deterioration of offset resistance can be prevented. When the weight average molecular weight is 100,000 or less, deterioration of low temperature fixability can be prevented.

Near-Infrared Absorbing Material

The near-infrared absorbing material may be either an inorganic material or an organic material.

Various infrared absorbing materials having transparency (i.e., being invisible) have been proposed for additional data embedding technology.

Examples of inorganic near-infrared absorbing materials include, but are not limited to, glass composed of a glass network forming component which transmits light in the visible range, such as phosphoric acid, silica, and boric acid, to which a transition metal ion, a coloring material composed of inorganic and/or organic compounds, or the like is added; and crystallized glass obtained by crystallizing the above glass by heat treatment. These inorganic materials can well reflect light in the visible range to provide invisible images.

Examples of organic near-infrared absorbing materials include, but are not limited to, colored materials such as phthalocyanine compounds and anthraquinone compounds; and colorless materials such as aluminum salt compounds and naphthalocyanine compounds. Among them, colorless materials are preferable because they do not cause coloring of an image. In addition, the addition amount thereof can be low because they sufficiently absorb infrared light with a small amount. As a result, the quality of the color image does not deteriorate.

Among such colorless materials, naphthalocyanine compounds are preferable because the absorbance thereof in the visible light region is very low, the characteristic thereof is nearly colorless, and the effect thereof on charging of the toner is small.

The naphthalocyanine compounds are not particularly limited and may be appropriately selected according to the purpose, but the compounds exemplified below are preferred.

Chemical Formula (1)

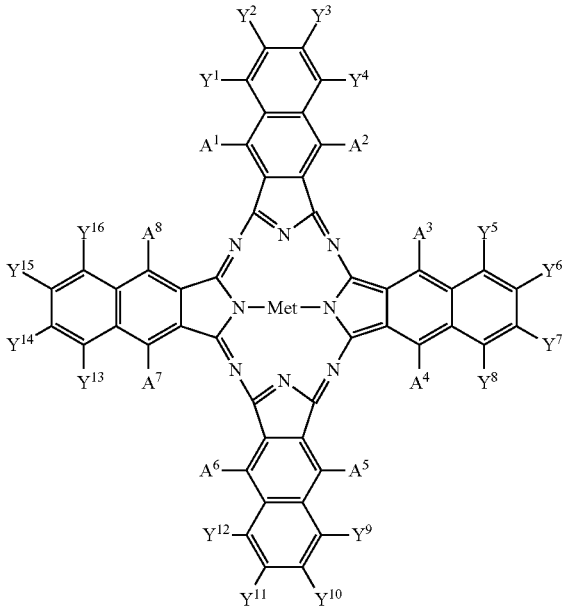

In the chemical formula (1), Met represents two hydrogen atoms, a divalent metal atom, or a trivalent or tetravalent substituted metal atom; each of A1 to A8 independently represents a hydrogen atom, a halogen atom, a substituted or unsubstituted alkyl group, a substituted or unsubstituted aryl group, a substituted or unsubstituted alkoxy group, a substituted or unsubstituted aryloxy group, a substituted or unsubstituted alkylthio group, or a substituted or unsubstituted arylthio group, where, in each of combinations of A1 and A2, A3 and A4, A5 and A6, and A7 and A8, both elements do not simultaneously represent a hydrogen atom or a halogen atom; and each of Y1 to Y16 independently represents a hydrogen atom, a halogen atom, a substituted or unsubstituted alkyl group, a substituted or unsubstituted aryl group, a substituted or unsubstituted alkoxy group, a substituted or unsubstituted aryloxy group, a substituted or unsubstituted alkylthio group, a substituted or unsubstituted arylthio group, a substituted or unsubstituted alkylamino group, a substituted or unsubstituted dialkylamino group, a substituted or unsubstituted arylamino group, a substituted or unsubstituted diarylamino group, a substituted or unsubstituted alkylarylamino group, a hydroxy group, a mercapto group, a nitro group, a nitrile group, an oxycarbonyl group, an alkoxycarbonyl group, an aryloxycarbonyl group, an aminocarbonyl group, or a mono- or di-substituted aminocarbonyl group.

The reflectance of the near-infrared absorbing material at a reading wavelength is preferably 50% or less for stable reading by a machine upon infrared light irradiation. When the reflectance is 50% or less, deterioration of reading accuracy can be prevented.

The reflectance may be measured from the output solid image using a spectrophotometer (e.g., V-660 manufactured by JASCO Corporation, eXact manufactured by X-Rite Inc.).

The near-infrared absorbing material is preferably dispersed in the toner particles.

In a case in which the near-infrared absorbing material is externally fixed on the surface of the toner particles or mixed in the toner particles, aggregation may occur in the toner particles or developer. Even in a case in which a necessary amount of the near-infrared absorbing material is added as a bulk, in the process of externally fixing it on the surface of the toner particles or preparing a developer, a part thereof is lost due to adhesion to equipment, causing lack or uneven distribution of the near-infrared absorbing material in the IR image. As a result, information cannot be read out accurately and stably. In addition, there is a possibility that free particles of the near-infrared absorbing material contaminate the interior, particularly a photoconductor, thereby adversely affecting other processes such as development and transfer processes.

In particular, the organic near-infrared absorbing material can be better dispersed in a binder resin than inorganic materials. Therefore, in the case of using the organic near-infrared absorbing material, it possible to record information at a high density since the organic near-infrared light absorbing material can be evenly dispersed in an IR image formed on an image output medium while showing sufficient absorptivity in the infrared region without impairing invisibility in the visible region. In addition, either reading of an IR image by a machine or decoding process can be stably performed for an extended period of time.

The content of the near-infrared absorbing material varies depending on the characteristics thereof. Regardless of the type of the near-infrared absorbing material, absorption of near-infrared light becomes insufficient if the content is insufficient. If absorption of near-infrared light is insufficient, a large amount of IR toner must be adhered to a medium such as paper. In this case, visible irregularities are produced due to generation of an aggregate (bulk) of IR toner as well as resources are wasted. When the content of the near-infrared absorbing material is excessive, the near-infrared absorbing material slightly absorbs light in the visible light wavelength region. As a result, disadvantageously, the near-infrared absorbing material becomes easily visually recognizable.

In the case of using vanadyl naphthalocyanine known to be used as a transparent (invisible) near-infrared absorbing material, the content thereof in the IR toner is preferably from 0.3% to 1.0% by mass.

Other Components

The other components are not particularly limited as long as they are contained in the toner and can be appropriately selected according to the purpose. Examples thereof include, but are not limited to, a release agent, a charge controlling agent, and an external additive.

Release Agent

Examples of the release agent include, but are not limited to, natural waxes and synthetic waxes. Each of these materials can be used alone or in combination with others.

Specific examples of the natural waxes include, but are not limited to: plant waxes such as carnauba wax, cotton wax, sumac wax, and rice wax; animal waxes such as bees wax and lanolin; mineral waxes such as ozokerite and ceresin; and petroleum waxes such as paraffin wax, microcrystalline wax, and petrolatum wax.

Specific examples of the synthetic waxes include, but are not limited to: synthetic hydrocarbon waxes such as Fischer-Tropsch wax and polyethylene wax; synthetic waxes such as esters, ketones, and ethers; fatty acid amides such as 1,2-hydroxystearic acid amide, stearic acid amide, phthalic anhydride imide, and chlorinated hydrocarbons; and crystalline polymers, such as homopolymers and copolymers of polyacrylates such as n-stearyl polymethacrylate and n-lauryl polymethacrylate (e.g., n-stearyl acrylate-ethyl methacrylate copolymer), which are low-molecular-weight crystalline polymers, having a long-chain alkyl group on its side chain.

Preferably, the release agent comprises a monoester wax. Since the monoester wax has low compatibility with general binder resins, the monoester wax easily exudes out to the surface of the toner when the toner is fixed. Thus, the toner exhibits high releasability while securing high gloss and sufficient low-temperature fixability.

Preferably, the monoester wax is of a synthetic ester wax. Examples of the synthetic ester wax include, but are not limited to, a monoester wax synthesized from a long-chain linear saturated fatty acid and a long-chain linear saturated alcohol. The long-chain linear saturated fatty acid is represented by the general formula $C_nH_{2n+1}COOH$, and n is preferably about 5 to 28. The long-chain linear saturated alcohol is represented by the general formula $C_nH_{2n+1}OH$, and n is preferably about 5 to 28.

Specific examples of the long-chain linear saturated fatty acid include, but are not limited to, capric acid, undecylic acid, lauric acid, tridecylic acid, myristic acid, pentadecylic acid, palmitic acid, heptadecanoic acid, tetradecanoic acid, stearic acid, nonadecanoic acid, behenic acid, lignoceric acid, cerotic acid, heptacosanoic acid, montanic acid, and melissic acid. Specific examples of the long-chain linear saturated alcohol include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol, all of which may have a substituent such as a lower alkyl group, amino group, and halogen.

Preferably, the release agent has a melting point of from 50° C. to 120° C. When the melting point of the release agent is in the above numerical range, the release agent can effectively act at the interface between a fixing roller and the toner, thereby improving high-temperature offset resistance of the toner without applying another release agent such as an oil to the fixing roller. Specifically, when the melting point is 50° C. or higher, deterioration of heat-resistant storage stability of the toner can be prevented. When the melting point is 120° C. or less, deterioration of cold offset resistance and paper winding on the fixing device, which may be caused when releasability is not developed at low temperatures, can be prevented.

The melting point of the release agent can be determined from the maximum endothermic peak measured by a differential scanning calorimeter TG-DSC system TAS-100 (manufactured by Rigaku Corporation).

The content of the release agent in the binder resin is preferably from 1% to 20% by mass, more preferably from 3% to 10% by mass. When the content is 1% by mass or more, deterioration of the offset preventing effect can be prevented. When the content is 20% by mass or less, deterioration of transferability and durability can be prevented.

The content of the monoester wax is preferably from 4 to 8 parts by mass, more preferably 5 to 7 parts by mass, based on 100 parts by mass of the IR toner. When the content is 4 parts by mass or more, exudation to the surface of the toner at the time of fixing will not become insufficient and deterioration of releasability, gloss value, low-temperature fixability, and high-temperature offset resistance can be prevented. When the content is 8 parts by mass or less, deterioration of storage stability and filming property (on a photoconductor, etc.) of the toner, which may be caused when the amount of release agent deposited on the surface of the toner is increased, can be prevented.

The toner according to the present embodiment preferably contains a wax dispersing agent. Preferably, the wax dispersing agent is a copolymer composition containing at least styrene, butyl acrylate, and acrylonitrile as monomers, or a polyethylene adduct of the copolymer composition.

The content of the wax dispersing agent is preferably 7 parts by mass or less based on 100 parts by mass of the IR toner. The wax dispersing agent has an effect of dispersing the wax in the toner, so that storage stability of the toner is reliably improved regardless of production method of the toner. In addition, the diameter of the wax is reduced due to the effect of the wax dispersing agent, so that the toner is suppressed from filming on a photoconductor, etc. When the content is 7 parts by mass or less, various undesirable phenomena can be prevented. For example, gloss decrease caused due to an increase of the amount of polyester-incompatible components is prevented. Also, decrease of low-temperature fixability and hot offset resistance caused due to insufficient exudation of the wax to the surface of the toner at the time of fixing is prevented, because excessive increase of dispersibility of the wax is prevented although filming resistance is improved.

Charge Controlling Agent

Specific examples of usable charge controlling agents include, but are not limited to, nigrosine dyes, triphenylmethane dyes, chromium-containing metal complex dyes, chelate pigments of molybdic acid, Rhodamine dyes, alkoxyamines, quaternary ammonium salts (including fluorine-modified quaternary ammonium salts), alkylamides, phosphor and phosphor-containing compounds, fluorine activators, metal salts of salicylic acid, and metal salts of salicylic acid derivatives. Each of these materials can be used alone or in combination with others.

These charge controlling agents are available either synthetically or commercially. Specific examples of commercially available products include, but are not limited to: BONTRON 03, BONTRON P-51, BONTRON S-34, E-82, E-84, and E-89 (all manufactured by Orient Chemical Industries Co., Ltd.); TP-302, TP-415, COPY CHARGE PSY VP2038, COPY BLUE PR, COPY CHARGE NEG VP2036, and COPY CHARGE NX VP434 (all manufactured by Hoechst AG); and LRA-901 and LR-147 (all manufactured by Japan Carlit Co., Ltd.).

The content of the charge controlling agent can be appropriately determined depending on the type of the binder resin, the presence or absence of an optional additive, and/or the toner production method including dispersing method, but is preferably from 0.1 to 5 parts by mass, more preferably from 0.2 to 2 parts by mass, based on 100 parts by mass of the binder resin. When the content is 5 parts by mass or less, deterioration of developer fluidity and/or image density can be prevented because the charge of the toner is not so large that the effect of the charge control agent is not reduced and the electrostatic force between the toner and the developing roller is not increased.

Among the above charge controlling agents, metal salts having 3 or more valences are capable of controlling thermal properties of the toner. By containing such a metal salt in the toner, a cross-linking reaction with an acidic group of the binder resin proceeds at the time of fixing to form a weak three-dimensional cross-linkage, whereby high temperature offset resistance is achieved while low-temperature fixability is maintained.

Examples of the metal salt include, but are not limited to, a metal salt of a salicylic acid derivative and a metal salt of acetylacetonate. The metal is not particularly limited as long as it is a polyvalent ionic metal having 3 or more valences, and can be appropriately selected according to the purpose. Examples thereof include iron, zirconium, aluminum, titanium, and nickel. Among them, metal compounds of salicylic acid having 3 or more valences are preferred.

Preferably, the content of the metal salt is in the range of from 0.5 to 2 parts by mass, more preferably from 0.5 to 1 parts by mass, based on 100 parts by mass of the IR toner. When the content is 0.5 parts by mass or more, deterioration of offset resistance can be prevented. When the content is 2 parts by mass or less, deterioration of gloss value can be prevented.

External Additive

The external additive may be contained in the toner to assist fluidity, developability, and chargeability of the toner. The external additive is not particularly limited and may be appropriately selected according to the purpose. Examples of the external additive include, but are not limited to, fine inorganic particles and fine polymeric particles.

Specific examples of the fine inorganic particles include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Each of these materials can be used alone or in combination with others.

Specific examples of the fine polymeric particles include, but are not limited to, polystyrene particles obtained by soap-free emulsion polymerization, suspension polymerization, or dispersion polymerization; particles of copolymer of methacrylates and/or acrylates; particles of polycondensation polymer such as silicone, benzoguanamine, and nylon; and thermosetting resin particles.

The external additive may be surface-treated with a surface treatment agent to improve its hydrophobicity to prevent deterioration of fluidity and chargeability of the toner even under high-humidity conditions.

Specific examples of the surface treatment agent include, but are not limited to, silane coupling agents, silylation agents, silane coupling agents having a fluorinated alkyl group, organic titanate coupling agents, aluminum coupling agents, silicone oils, and modified silicone oils.

The external additive preferably has a primary particle diameter of from 5 nm to 2 μm, and more preferably from 5 nm to 500 μm. The external additive preferably has a specific surface area in the range of from 20 to 500 $m^2/g$ measured according to the BET method.

Preferably, the content of the external additive in the IR toner is from 0.01% to 5% by mass, more preferably from 0.01% to 2.0% by mass.

Cleanability Improving Agent

The cleanability improving agent may be contained in the toner to remove residual developer remaining on a photoconductor or primary transfer medium after image transfer. Specific examples of the cleanability improving agent include, but are not limited to: metal salts of fatty acids, such as zinc stearate and calcium stearate; and fine particles of polymers prepared by soap-free emulsion polymerization etc., such as fine polymethyl methacrylate particles and fine polystyrene particles. Preferably, the particle size distribution of the fine polymer particles is relatively narrow and the volume average particle diameter thereof is in the range of from 0.01 to 1 μm.

Color Toner

The color toner contains a binder resin and a colorant, and further contains other components as necessary. Examples of the other components include the same components exemplified above.

Preferably, the color toner is any one of a cyan toner, a magenta toner, and a yellow toner. More preferably, the color toner includes a cyan toner, a magenta toner, and a yellow toner. In other words, in the toner set, preferably, the 60-degree gloss value of a solid image of the IR toner is 10 degrees or more higher than the 60-degree gloss value of a solid image of any one of the cyan toner, magenta toner, and yellow toner. More preferably, the 60-degree gloss value of a solid image of the IR toner is 10 degrees or more higher than the 60-degree gloss value of solid images of all the cyan, magenta, and yellow toners.

Binder Resin

A toner image formed by the color toner according to the present embodiment preferably has a gloss value lower than that of general offset printed matter.

Therefore, the binder resin contained in the color toner preferably contains gel, although the binder resin is not particularly limited and can be appropriately selected according to the purpose. The gel fraction in the binder resin is preferably in the range of from 0.5% to 20% by mass, more preferably from 1.0% to 10% by mass.

Even when no gel is contained, the binder resin of the color toner preferably contains a high molecular weight component having a weight average molecular weight Mwc of 100,000 or more, which is larger than the weight average molecular weight Mwi of the binder resin of the IR toner. When the weight average molecular weight Mwc of the binder resin of the color toner is larger than the weight average molecular weight Mwi of the binder resin of the IR toner, the resulting color image has a 60-degree gloss value of about 10 to 30, which has higher visibility than offset printed matter.

Colorant

As the colorant, those having a small absorption in a wavelength range of 800 nm or higher are preferable. Specific examples of such colorants include, but are not limited to, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, dioxane violet, Anthraquinone Violet, Chrome Green, zinc green, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, perylene black, perinone black, and mixtures thereof. Each of these materials can be used alone or in combination with others.

When the color toner is used as a process color toner, the following colorants are preferably used for each of cyan, magenta, and yellow toners.

For cyan toner, C.I. Pigment Blue 15:3 is preferable. For magenta toner, C.I. Pigment Red 122, C.I. Pigment Red 269, and C.I. Pigment Red 81:4 are preferable. For yellow toner, C.I. Pigment Yellow 74, C.I. Pigment Yellow 155, C.I. Pigment Yellow 180, and C.I. Pigment Yellow 185 are preferable. Each of these colorants can be used alone or in combination with others.

The absorbance of the colorant at 800 nm or more is preferably less than 0.05, more preferably less than 0.01. When the absorbance is less than 0.05, the color toner superimposed on the IR toner is prevented from inhibiting reading of information formed with IR toner.

The content of the colorant is preferably from 3% to 12% by mass, more preferably from 5% to 10% by mass, based on the total mass of the color toner of each color, although it depends on the coloring power of each colorant. When the content is 3% by mass or more, coloring power of the toner is sufficient, so that the amount of deposited toner will not be increased and waste of resources is prevented. When the content is 12% by mass or less, chargeability of the toner is not greatly affected, so that it will not become difficult to stably maintain the amount of toner charge.

Properties of IR Toner and Color Toner

The 60-degree gloss value of the solid image of the IR toner is 30 or more, preferably from 30 to 80, more preferably from 30 to 60. When the 60-degree gloss value of the solid image is less than 30, visibility of the IR toner image is increased and the IR toner image fails to function as a concealed image. When the 60-degree gloss value of the solid image is larger than 80, the molecular weight of the toner resin is small and it may be difficult to maintain a sufficient fixable temperature range.

The 60-degree gloss value of the solid image of the color toner is preferably in a range of from 10 to 40, more preferably from 15 to 35. When the gloss value is within the above numerical range, the color toner image has a relatively low gloss.

The 60-degree gloss value of the solid image of the IR toner is preferably 10 degrees or more higher, preferably 15 degrees or more higher, more preferably 20 degrees or more higher, than the 60-degree gloss value of the solid image of the color toner. When the difference between the 60-degree gloss value of the solid image of the IR toner and the 60-degree gloss value of the solid image of the color toner is less than 10, in the case of superimposing the color toner image on the IR toner image formed on an image output medium before image fixation is conducted, the color toner of the upper layer enters the lower IR toner layer by application of heat and pressure, resulting in deterioration of visibility of the color toner image. When the gloss value of the solid image of the IR toner is higher than the gloss value of the solid image of the color toner, visibility of the color toner image on the upper layer is improved. As a result, the IR toner image on the lower layer becomes difficult to visually recognize.

The absorbance of the solid image of the color toner at 800 nm or more is preferably less than 0.05, more preferably less than 0.01.

The gloss value of the solid image of each of the IR toner and the color toner can be adjusted by, for example, adjusting the gel fraction in the binder resin or adjusting the weight average molecular weight of the binder resin. The greater the gel fraction in the binder resin, the lower the gloss value. The closer the gel fraction to 0, the higher the gloss value. In a case in which the binder resin contains no gel, the greater the weight average molecular weight of the binder resin, the lower the gloss value. In addition, the smaller the weight average molecular weight, the higher the gloss value.

When the binder resin comprises a resin having an acid value, the gloss value can be adjusted by adding a metal salt having 3 or more valences thereto. As the acid value of the binder resin and the added amount of the metal salt increase, the gloss value is likely to become lower. As the acid value of the binder resin and the added amount of the metal salt decrease, the gloss value is likely to become higher.

The weight average molecular weight (Mwi) of IR toner is preferably from 6,000 to 12,000, more preferably from 7,500 to 10,000.

The weight average molecular weight can be determined from a molecular weight distribution of THF-soluble matter that is measured with a GPC (gel permeation chromatography) measuring instrument GPC-150C (manufactured by Waters Corporation).

For example, the weight average molecular weight can be measured using columns (SHODEX KF 801 to 807 manufactured by Showa Denko K.K.) as follows.

The columns are stabilized in a heat chamber at 40° C. A solvent tetrahydrofuran (THF) is let to flow in the columns at that temperature at a flow rate of 1 ml/min. Next, 0.05 g of a sample is thoroughly dissolved in 5 g of THF and thereafter filtered with a pretreatment filter (for example, a chromatographic disk having a pore size of 0.45 μm (manufactured by KURABO INDUSTRIES LTD.)), so that a THF solution of the sample having a sample concentration of from 0.05% to 0.6% by mass is prepared. The THF solution of the sample thus prepared in an amount of from 50 to 200 μL is injected in the measuring instrument.

The gel fraction in the IR toner is preferably from 0% to 2% by mass.

The gel fraction can be calculated from the dry weight of the component filtered by a pretreatment filter which was used in the measurement of weight average molecular weight.

The ratio (Mw/Mn) of the weight average molecular weight (Mw) to the number average molecular weight (Mn) of the IR toner is preferably 5 or less, more preferably 4 or less.

The weight average molecular weight (Mw) and the number average molecular weight (Mn) are determined by comparing the molecular weight distribution of the IR toner with a calibration curve that has been compiled with several types of monodisperse polystyrene standard samples. Specifically, the calibration curve shows the relation between the logarithmic values of molecular weights and the number of counts.

The polystyrene standard samples include, for example, those having molecular weights of 6×102, 2.1×102, 4×102, 1.75×104, 5.1×104, 1.1×105, 3.9×105, 8.6×105, 2×106, and 4.48×106, respectively (available from Pressure Chemical Company or Tosoh Corporation). Preferably, the calibration curve is prepared using at least 10 standard polystyrene samples. As the detector, a refractive index (RI) detector is used.

The acid value of the IR toner is preferably 12 mgKOH/g or less, more preferably from 6 to 12 mgKOH/g. The acid value can be adjusted to the above numerical range when the binder resin comprises a polyester resin. In this case, it is easy to achieve both low-temperature fixability and hot offset resistance.

The acid values of the toner and the binder resin in the present embodiment were measured under the following conditions in accordance with the measuring method described in JIS K 0070-1992.

First, a sample solution was prepared by dissolving 0.5 g (0.3 g in the case of ethyl acetate soluble component) of the toner or binder resin in 120 mL of toluene by stirring them at room temperature (23° C.) for about 10 hours. Further, 30 mL of ethanol is mixed therein, thus preparing a sample solution.

The acid value is calculated as follows using an instrument. Specifically, the sample solution was titrated with N/10 potassium hydroxide alcohol solution standardized in advance. The acid value was calculated from the consumed amount of the potassium hydroxide alcohol solution in the titration according to the following formula. Acid Value=KOH (mL)×N×56.1/Mass of Sample where N represents the factor of the N/10 potassium hydroxide alcohol solution.

In the following Examples and Comparative Examples, the acid value of the binder resin and the acid value of the toner were substantially the same. Therefore, the acid value of the binder resin is treated as the acid value of the toner in the present disclosure.

Particle Diameter of Toner

The weight average particle diameter of the IR toner is preferably from 5 to 7 μm, more preferably from 5 to 6 μm.

The weight average particle diameter of the color toner is preferably from 4 to 8 μm, more preferably from 5 to 7 μm.

When the weight average particle diameter is within the above range, fine dots with 600 dpi or more can be reproduced and high quality images can be obtained. This is because the particle diameter of the toner particles is sufficiently smaller than minute dots of a latent image and thus excellent dot reproducibility is exhibited.

Particularly, when the IR toner particles are arranged at high density after being transferred onto an image output medium before being fixed thereon so that the color toner particles to be superimposed thereon do not enter the gap between the IR toner particles, the resulting fixed image has high reproducibility. The image with high reproducibility can be read by a machine in a more stable manner upon infrared light irradiation.

When the weight average particle diameter (D4) of the color toner is 4 μm or more, undesirable phenomena such as reduction of transfer efficiency and deterioration of blade cleaning property can be prevented. When the weight average particle diameter (D4) of the color toner is 8 μm or less, undesirable phenomena can be prevented. For example, disturbance of image, caused when the color toner superimposed on an unfixed image gets in the image, can be prevented. In addition, it will not become difficult to prevent scattering of texts and lines.

The ratio (D4/D1) of the weight average particle diameter (D4) to the number average particle diameter (D1) is preferably from 1.00 to 1.40, more preferably from 1.05 to 1.30. The closer the ratio (D4/D1) to 1.00, the narrower the particle diameter distribution.

With such a toner having a small particle diameter and a narrow particle diameter distribution, since the charge amount distribution is uniform, a high-quality image with less background fog can be obtained. In addition, in an electrostatic transfer method, the transfer rate can be increased.

In a full-color image forming method for forming a multicolor image by superimposing toner images of different colors, compared to a monochrome image forming method for forming an image with only black toner without superimposing toner images of different colors, the amount of toner deposited on paper is larger.

That is, since the amount of toner to be developed, transferred, and fixed is increased, the above-described undesirable phenomena that deteriorate image quality, such as reduction of transfer efficiency, deterioration of blade cleaning property, scattering of texts and lines, and background fog, are likely to occur. Thus, the weight average particle diameter (D4) and the ratio (D4/D1) of the weight average particle diameter (D4) to the number average particle diameter (D1) are properly controlled.

The particle size distribution of toner particles can be measured using an apparatus for measuring the particle size distribution of toner particles by the Coulter principle. Examples of such an apparatus include, but are not limited to, COULTER COUNTER TA-II and COULTER MULTISIZER II (both manufactured by Beckman Coulter Inc.).

Specific measuring procedure is as follows.

First, 0.1 to 5 mL of a surfactant (e.g., an alkylbenzene sulfonate), as a dispersant, is added to 100 to 150 mL of an electrolyte solution. Here, the electrolyte solution is an about 1% NaCl aqueous solution prepared with the first grade sodium chloride. As the electrolyte solution, for example, ISOTON-II (available from Beckman Coulter, Inc.) can be used.

Further, 2 to 20 mg of a sample was added thereto. The electrolyte in which the sample is suspended is subjected to a dispersion treatment using an ultrasonic disperser for about 1 to 3 minutes and then to the measurement of the weight and number of toner particles using the above-described instrument equipped with a 100-μm aperture to calculate weight and number distributions. The weight average particle diameter (D4) and number average particle diameter (D1) of the toner can be calculated from the weight and number distributions obtained above.

Thirteen channels with the following ranges are used for the measurement: 2.00 or more and less than 2.52 μm; 2.52 or more and less than 3.17 μm; 3.17 or more and less than 4.00 μm; 4.00 or more and less than 5.04 μm; 5.04 or more and less than 6.35 μm; 6.35 or more and less than 8.00 μm; 8.00 or more and less than 10.08 μm; 10.08 or more and less than 12.70 μm; 12.70 or more and less than 16.00 μm; 16.00 or more and less than 20.20 μm; 20.20 or more and less than 25.40 μm; 25.40 or more and less than 32.00 μm; and 32.00 or more and less than 40.30 μm. Thus, particles having a particle diameter of 2.00 or more and less than 40.30 μm are to be measured.

It is generally known that the loss tangent (tan δ) of toner for electrophotographic development clearly correlates with the gloss value of an image formed with the toner. As tan δ increases, ductility of toner is increased at the time of fixing and substrate hiding property of toner is enhanced, so that a high gloss image is obtained.

Preferably, the loss tangent (tan δi) of the IR toner at 100° C. to 140° C. is 2.5 or more, more preferably 3.0 or more. In addition, preferably, tan δi is 15 or less. Here, a state in which the loss tangent (tan δi) of the IR toner at 100° C. to 140° C. is 2.5 or more refers to a state in which the loss tangent (tan δi) of the IR toner is always 15 or more in a temperature range of from 100° C. to 140° C.

Preferably, the loss tangent (tan δc) of the color toner is 2 or less. In addition, preferably, tank is 0.1 or more. When the loss tangent of the color toner is 2 or less, the color toner superimposed on the IR toner is prevented from entering the IR toner image, thus preventing deterioration of stability of the IR toner image. Here, a state in which the loss tangent (tan δc) of the color toner at 100° C. to 140° C. is 2 or less refers to a state in which the loss tangent (tan δc) of the color toner is always 2 or less in a temperature range of from 100° C. to 140° C.

The loss tangent (tan δ) of toner for electrophotographic development is represented by the ratio (G"/G') of the loss elastic modulus (G") to the storage elastic modulus (G') that can be determined by viscoelasticity measurement. For example, the loss elastic modulus (G") and the storage elastic modulus (G') can be measured by the following method. First, 0.8 g of the IR toner or color toner is molded using a die having a diameter of 20 mm at a pressure of 30 MPa. The molded toner is subjected to a measurement of loss elastic modulus (G"), storage elastic modulus (G'), and loss tangent (tan δ) using an instrument ADVANCED RHEOMETRIC EXPANSION SYSTEM (manufactured by TA Instruments) equipped with a parallel cone having a diameter of 20 mm under a frequency of 1.0 Hz, a temperature rising rate of 2.0° C./min, and a strain of 0.1% (under automatic strain control in which the allowable minimum stress is 1.0 g/cm, allowable maximum stress is 500 g/cm, maximum applied strain is 200%, and strain adjustment is 200%). GAP is set within a range such that FORCE becomes 0 to 100 μm after the sample is set.

Toner Production Method

The toners of the toner set according to the present embodiment may be produced by conventionally known methods such as melt-kneading-pulverization methods and polymerization methods. The color toner and the IR toner may be produced by either the same production method or different production methods. For example, it is possible that the color toner is produced by a polymerization method and the IR toner is produced by a melt-kneading-pulverization method.

Melt-Kneading-Pulverization Method

The melt-kneading-pulverization method includes the processes of (1) melt-kneading at least the binder resin, the colorant or the near-infrared absorbing material, and the release agent, (2) pulverizing/classifying the melt-kneaded toner composition, and (3) externally adding fine inorganic particles. It is preferable that fine powder produced in the pulverizing/classifying process (2) is reused as a raw material in the process (1) for saving cost.

Examples of kneaders used for the kneading include, but are not limited to, closed kneaders, single-screw or twin-screw extruders, and open-roll kneaders. Specific examples of the kneaders include, but are not limited to, KRC KNEADER (from Kurimoto, Ltd.); BUSS CO-KNEADER (from Buss AG); TWIN SCREW COMPOUNDER TEM (from Toshiba Machine Co., Ltd.); TWIN SCREW EXTRUDER TEX (from The Japan Steel Works, Ltd.); TWIN SCREW EXTRUDER PCM (from Ikegai Co., Ltd.); THREE ROLL MILL, MIXING ROLL MILL, and KNEADER (from Inoue Mfg., Inc.); KNEADEX (from Nippon Coke & Engineering Company, Limited); MS TYPE DISPERSION MIXER and KNEADER-RUDER (from Nihon Spindle Manufacturing Co., Ltd (formerly Moriyama Company Ltd.)), and BANBURY MIXER (from Kobe Steel, Ltd.).

Specific examples of pulverizers include, but are not limited to, COUNTER JET MILL, MICRON JET, and INOMIZER (from Hosokawa Micron Corporation); IDS-TYPE MILL and PJM JET MILL (from Nippon Pneumatic Mfg. Co., Ltd.); CROSS JET MILL (from Kurimoto, Ltd.); NSE-ULMAX (from Nisso Engineering Co., Ltd.); SK JET-O-MILL (from Seishin Enterprise Co., Ltd.); KRYPTRON (from Kawasaki Heavy Industries, Ltd.); TURBO MILL (from Freund-Turbo Corporation); and SUPER ROATER (from Nisshin Engineering Inc.).

Specific examples of classifiers include, but are not limited to, CLASSIEL, MICRON CLASSIFIER, and SPEDIC CLASSIFIER (from Seishin Enterprise Co., Ltd.); TURBO CLASSIFIER (from Nisshin Engineering Inc.); MICRON SEPARATOR, TURBOPLEX ATP, and TSP SEPARATOR (from Hosokawa Micron Corporation); ELBOW JET (from Nittetsu Mining Co., Ltd.); DISPERSION SEPARATOR (from Nippon Pneumatic Mfg. Co., Ltd.); and YM MICRO CUT (from URAS TECHNO CO., LTD. (formerly Yaskawa & Co., Ltd.)).

Specific examples of sieving devices for sieving coarse particles include, but are not limited to, ULTRASONIC (manufactured by Koei Sangyo Co., Ltd.); RESONASIEVE and GYRO-SIFTER (manufactured by Tokuju Corporation); VIBRASONIC SYSTEM (manufactured by DALTON CORPORATION); SONICLEAN (manufactured by SINTOKOGIO, LTD.); TURBO SCREENER (manufactured by FREUND-TURBO CORPORATION); MICRO SIFTER (manufactured by MAKINO MFG. CO., LTD.); and circular vibration sieves.

Polymerization Method

Examples of the polymerization method include conventionally known methods. The polymerization method may be conducted by the following procedure. First, the colorant, the binder resin, and the release agent are dispersed in an organic solvent to prepare a toner material liquid (oil phase). Preferably, a polyester prepolymer (A) having an isocyanate group is added to the toner material liquid and allowed to react during granulation so as to form a urea-modified polyester resin in the toner.

Next, the toner material liquid is emulsified in an aqueous medium in the presence of a surfactant and fine resin particles.

The aqueous medium comprises an aqueous solvent. The aqueous solvent may comprise water alone or an organic solvent such as an alcohol.

The used amount of the aqueous solvent is preferably from 50 to 2,000 parts by mass, more preferably from 100 to 1,000 parts by mass, based on 100 parts by mass of the toner material liquid.

The fine resin particles are not particularly limited and can be appropriately selected according to the purpose as long as they are capable of forming an aqueous dispersion thereof. Examples thereof include, but are not limited to, vinyl resins, polyurethane resins, epoxy resins, and polyester resins.

After the toner material liquid is emulsified (dispersed) in the aqueous medium, the emulsion (i.e., reactant) is subjected to removal of the organic solvent and subsequent washing and drying to obtain mother toner particles.

The IR toner and the color toner each can be used as a one-component developer or a two-component developer.

In a case in which the toner according to the present embodiment is used as a two-component developer, the toner is mixed with a magnetic carrier. The content of the toner in the developer is preferably from 1 to 10 parts by mass based on 100 parts by mass of the carrier.

Examples of the magnetic carrier include conventionally known materials such as iron powder, ferrite powder, magnetite powder, and magnetic resin carriers, each having a particle diameter of about 20 to 200 μm, but are not limited thereto.

Such magnetic carriers may be coated. Specific examples of coating materials for coating the magnetic carrier include, but are not limited to, amino resins (e.g., urea-formaldehyde resin, melamine resin, benzoguanamine resin, urea resin, polyamide resin, epoxy resin), polyvinyl and polyvinylidene resins (e.g., acrylic resin, polymethyl methacrylate resin, polyacrylonitrile resin, polyvinyl acetate resin, polyvinyl alcohol resin, polyvinyl butyral resin), styrene resins (e.g., polystyrene resin, styrene-acrylic copolymer resin), halogenated olefin resins (e.g., polyvinyl chloride), polyester resins (e.g., polyethylene terephthalate, polybutylene terephthalate), polycarbonate resins, polyethylene resins, polyvinyl fluoride resins, polyvinylidene fluoride resins, poly(trifluoroethylene) resins, poly(hexafluoropropylene) resins, vinylidene fluoride-acrylic copolymer, vinylidene fluoride-vinyl fluoride copolymer, tetrafluoroethylene-vinylidene fluoride-non-fluoride monomer terpolymer, and silicone resins.

The coating material may contain a conductive powder. Specific examples of the conductive powder include, but are not limited to, metal powder, carbon black, titanium oxide, tin oxide, and zinc oxide. Preferably, the conductive powder has an average particle diameter of 1 μm or less. When the average particle diameter is 1 μm or less, control of electric resistance will not become difficult.

Image Forming Apparatus and Image Forming Method

An image forming apparatus according to the present embodiment includes: an electrostatic latent image bearer; an electrostatic latent image forming device configured to form an electrostatic latent image on the electrostatic latent image bearer; a developing device containing an IR toner and a color toner, configured to develop the electrostatic latent image into an IR toner image or a color toner image with the IR toner or the color toner, respectively; a transfer device configured to transfer the toner image onto a recording medium; and a fixing device configured to fix the transferred image on the recording medium. The image forming apparatus may further include other devices as necessary.

An image forming method according to the present embodiment includes the processes of: forming an electrostatic latent image on an electrostatic latent image bearer; developing the electrostatic latent image into a toner image; transferring the toner image onto a recording medium; and fixing the transferred image on the recording medium. The image forming method may further include other processes as necessary.

The image forming method according to the present embodiment can be suitably conducted by the image forming apparatus according to the present embodiment.

In the image forming method and the image forming apparatus, the 60-degree gloss value of the solid image of the IR toner is 30 or more, preferably from 30 to 80, more preferably from 30 to 60.

In the image forming method and the image forming apparatus according to one embodiment, the 60-degree gloss value of the solid image of the IR toner is preferably 10 degrees or more higher, preferably 15 degrees or more higher, more preferably 20 degrees or more higher, than the 60-degree gloss value of the solid image of the color toner.

In the image forming method and the image forming apparatus according to another embodiment, the loss tangent (tan δi) of the IR toner at 100° to 140° C. is preferably 2.5 or more, more preferably 3.0 or more. In the image forming method and the image forming apparatus, preferably, the loss tangent (tan δc) of the color toner is 2 or less.

On the recording medium, it is preferable that the IR toner image is formed closer to the recording medium than the color toner image is. The IR toner image can be formed closer to the recording medium than the color toner image by, for example, forming the color toner image after the IR toner image is formed on the recording medium.

The number of color toners used for forming the color toner image is not particularly limited and can be appropriately selected according to the purpose. In the case of using a plurality of color toners, either a plurality of toner images may be formed at the same time or single color toner images may be repeatedly formed and superimposed on each other. Repeatedly forming single color toner images and superimposing them on each other is more preferred. In forming the color toner image, the order of forming each single color toner image is not particularly limited.

The deposition amount of the IR toner in the IR toner image is preferably from 0.30 to 0.45 mg/cm$^2$, more preferably from 0.35 to 0.40 mg/cm$^2$. When the deposition amount of the IR toner is 0.30 mg/cm$^2$ or more, the substrate hiding rate of the image is sufficient and a reliable image can be obtained.

In addition, since the near-infrared absorbing material has slight absorption in the visible light region and is not completely colorless, visibility increases as the amount of the near-infrared absorbing material added to the toner increases. Visibility can be reduced by setting the deposition amount of the IR toner to 0.45 mg/cm$^2$ or less.

The toner deposition amount per unit area of the color toner image superimposed on the IR toner image is preferably in a range of from 30% to 80%. When the toner deposition amount per unit area of the color toner image is within this numerical range, visibility of the IR toner image below the color toner image can be sufficiently lowered, which is preferable.

The reason for this can be considered as follows. The IR toner of the present embodiment has slight absorption in the visible light region, and therefore an image formed only of the IR toner is not completely transparent. Therefore, in order to make IR image information invisible (to make it difficult to visually recognize), it is preferable to mask the IR toner image with the color toner. When the toner deposition amount per unit area of the color toner image is 30% or more, the IR toner image is effectively prevented from being visually recognizable. When the toner deposition amount per unit area of the color toner image is less than 30%, visibility of the IR toner image is increased particularly when yellow toner is superimposed thereon.

An image forming method in which the toner deposition amount per unit area of the color toner image on the IR toner image is from 30% to 80% is effective particularly when an image is formed by superimposing two-dimensional code images. In a case in which an image is formed by superimposing a two-dimensional code image formed with the IR toner and another two-dimensional code image formed with the color toner, each containing different information, and is read by reading devices of different light wavelengths (860 nm and 532 nm), it is possible to embed more information in the image than in a two-dimensional code image formed only with the color toner.

On the recording medium, it is preferable that a two-dimensional code image (i) being the IR toner image is formed closer to the recording medium than another two-dimensional code image (c) being the color toner image is. In this case, the absorbance of the solid image of the color toner at from 800 to 900 nm is preferably less than 0.05, more preferably less than 0.01.

Also, it is preferable that the two-dimensional code image (i) and the two-dimensional code image (c) contain different information.

In a case in which a two-dimensional code image of the IR toner and another two-dimensional code image of the color toner are superimposed, the two-dimensional code image of the color toner may be a dummy code. In such a case, the two-dimensional code image of the IR toner cannot be visually recognized and information thereof can only be read by a two-dimensional code reader of infrared light. The two-dimensional code image of the color toner can be visually recognized but information thereof cannot be read by the two-dimensional code reader of infrared light.

Here, as a specific example, how to use a two-dimensional code image using the IR toner is described below with an example of QR code (registered trademark).

Figure 14:
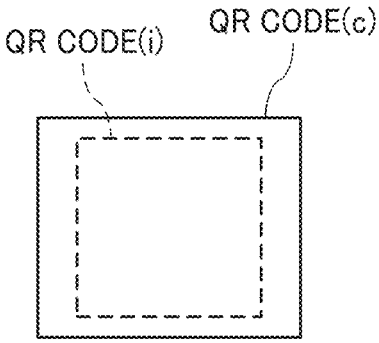
FIG. 14 is an explanatory diagram for a case in which a QR code (c) that is a two-dimensional code image formed with three color toners of Y, M, and C is superimposed on a QR code (i) that is a two-dimensional code image formed with the IR toner.

FIG. 14 is an explanatory diagram for a case in which a QR code (c) that is a two-dimensional code image formed with three color toners of Y, M, and C is superimposed on a QR code (i) that is a two-dimensional code image formed with the IR toner.

Here, the QR code (i) formed with the IR toner and the QR code (c) formed with the three color toners of Y, M, and C contain different information. The information contained in the QR code (i) formed with the IR toner is unreadable in the visible light region. Therefore, the information is unreadable by a normal scanner (image reader) but is readable only by a scanner using light in the infrared region. Thus, the QR code (i) formed with the IR toner is suitable for embedding highly confidential information such as personal information.

By utilizing the fact that the information contained in the the QR code (i) formed with the IR toner is unreadable by a normal scanner, it is possible to make the information readable only when both information contained in the QR code (i) formed with the IR toner and information contained in the QR code (c) formed with the three color toners of Y, M, and C are available. In this case, the information is readable by neither a scanner for the QR code (i) formed with the IR toner (i.e., a scanner corresponding only to the infrared light region) nor a normal scanner (i.e., a scanner corresponding only to the visible light region). The information is readable only by a special scanner corresponding to both the visible light region and the infrared light region. Therefore, it is suitable for embedding more highly confidential information.

EXAMPLES

Hereinafter, the toner used in the present embodiment will be described, but are not limited to these examples. In the following descriptions, "parts" represents "parts by mass" unless otherwise specified.

Production of IR Toner 1

Polyester Resin 1 (RN-306SF manufactured by Kao Corporation, having a weight average molecular weight Mw of 7,700 and an acid value of 4 mgKOH/g): 80 parts Polyester Resin 2 (RN-300SF manufactured by Kao Corporation, having a weight average molecular weight Mw of 11,000 and an acid value of 4 mgKOH/g): 10 parts Wax dispersant (EXD-001 manufactured by Sanyo Chemical Industries, Ltd.): 4 parts Monoester wax 1 (having a melting point mp of 70.5° C.): 6 parts Salicylic acid derivative zirconium salt A: 0.9 parts Vanadyl naphthalocyanine: 0.3 parts The vanadyl naphthalocyanine has the following structural formula (1) and was used as a near-infrared absorbing material. The salicylic acid derivative zirconium salt A has the following structural formula (2).

Structural Formula (1)

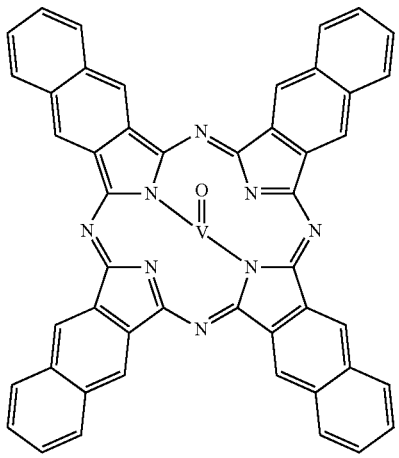

Structural Formula (2)

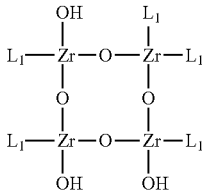

In the structural formula (2), $L_1$ represents the following structure.

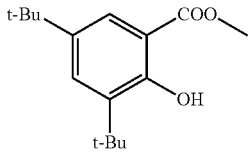

The toner raw materials listed above were preliminarily mixed by a HENSCHEL MIXER (FM20B available from NIPPON COKE & ENGINEERING CO., LTD.) and melt-kneaded by a single-shaft kneader (BUSS CO-KNEADER from Buss AG) at a temperature of from 100° C. to 130° C.

The kneaded product was cooled to room temperature and pulverized into coarse particles having a diameter of from 200 to 300 μm by a ROTOPLEX.

The coarse particles were further pulverized into fine particles having a weight average particle diameter of 4.5±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 5.2±0.2 μm and the ratio of weight average particle diameter to number average particle diameter became 1.20 or less. Thus, a mother toner 1 was prepared.

Subsequently, 100 parts of the mother toner 1 were mixed with additives including 1.3 parts of a fumed silica (ZD-30ST manufactured by Tokuyama Corporation), 1.5 parts of a fumed silica (UFP-35HH manufactured by Denka Company Limited), and 1.0 part of a titanium dioxide (MT-150AFM manufactured by Tayca Corporation) by a HENSCHEL MIXER, thus preparing an IR toner 1.

Production of IR Toner 2

An IR toner 2 was produced in the same manner as the IR toner 1 except for changing the amount of the vanadyl naphthalocyanine to 0.6 parts.

Production of IR Toner 3

An IR toner 3 was produced in the same manner as the IR toner 1 except for changing the amount of the vanadyl naphthalocyanine to 1.0 part.

Production of IR Toner 4

An IR Toner 4 was produced in the same manner as the IR Toner 2 except for replacing the polyester resin 2 with a polyester resin 3 (RN-290 SF manufactured by Kao Corporation, having an Mw of 87,000 and an acid value of 28 mgKOH/g).

The polyester resin 3 was synthesized from bisphenol A-polyethylene oxide addition alcohol, bisphenol A-ethylene oxide addition alcohol, fumaric acid, and trimellitic anhydride.

Production of IR Toner 5

An IR Toner 5 was produced in the same manner as the IR Toner 4 except for changing the amounts of the polyester resin 1 and the polyester resin 3 to 70 parts and 20 parts, respectively.

Production of IR Toner 6

A mother toner of an IR toner 6 was produced in the same manner as that of the IR toner 4 except for changing the amount of the vanadyl naphthalocyanine to 0.3 parts and changing the weight average particle diameter in the pulverization/classification process to 6.8±0.2 μm.

Subsequently, 100 parts of the mother toner were mixed with additives including 0.8 parts of a fumed silica (ZD-30ST manufactured by Tokuyama Corporation), 1.0 part of a fumed silica (UFP-35HH manufactured by Denka Company Limited), and 0.6 parts of a titanium dioxide (MT-150AFM manufactured by Tayca Corporation) by a HENSCHEL MIXER, thus preparing an IR toner 6.

Production of IR Toner 7

An IR toner 7 was produced in the same manner as the IR toner 6 except for changing the amount of the vanadyl naphthalocyanine to 0.6 parts.

Production of IR Toner 8

An IR toner 8 was produced in the same manner as the IR toner 5 except for changing the amount of the salicylic acid derivative zirconium salt A to 1.5 parts.

Production of IR Toner 9

A mother toner of an IR toner 9 was produced in the same manner as that of the IR toner 4 except for changing the weight average particle diameter in the pulverization/classification process to 8.0±0.2 μm.

Subsequently, 100 parts of the mother toner were mixed with additives including 0.6 parts of a fumed silica (ZD-30ST manufactured by Tokuyama Corporation), 0.8 parts of a fumed silica (UFP-35HH manufactured by Denka Company Limited), and 0.5 parts of a titanium dioxide (MT-150AFM manufactured by Tayca Corporation) by a HENSCHEL MIXER, thus preparing an IR toner 9.

Production of IR Toner 10

An IR toner 10 was produced in the same manner as the IR toner 1 except for changing the amount of the vanadyl naphthalocyanine to 0.2 parts.

Production of IR Toner 11

An IR toner 11 was produced in the same manner as the IR toner 4 except for changing the amount of the vanadyl naphthalocyanine to 1.2 parts.

Production of IR Toner 12

An IR Toner 12 was produced in the same manner as the IR Toner 4 except for changing the amounts of the polyester resin 1 and the polyester resin 3 to 60 parts and 30 parts, respectively.

Production of IR Toner 13

An IR toner 13 was produced in the same manner as the IR toner 6 except for replacing 0.3 parts of the vanadyl naphthalocyanine with 1.0 part of a near-infrared absorbing dye 1 (OPTLION NIR-761 manufactured by TOYOCOLOR CO., LTD.).

Production of IR Toner 14

An IR toner 14 was produced in the same manner as the IR toner 6 except for replacing 0.3 parts of the vanadyl naphthalocyanine with 2.0 parts of a near-infrared absorbing dye 1 (OPTLION NIR-761 manufactured by TOYOCOLOR CO., LTD.).

Production of Two-component Developer

Preparation of Carrier

Silicone resin (Organo straight silicone): 100 parts

Toluene: 100 parts

γ-(2-Aminoethyl) aminopropyl trimethoxysilane: 5 parts

Carbon black: 10 parts

The above materials were dispersed by a homomixer for 20 minutes to prepare a coating layer forming liquid. Manganese (Mn) ferrite particles having a weight average particle diameter of 35 μm, serving as core materials, were coated with the coating layer forming liquid using a fluidized bed coating device while controlling the temperature inside the fluidized bed to 70° C. The dried coating layer on the surface of the core material had an average film thickness of 0.20 μm. The core material having the coating layer was calcined in an electric furnace at 180° C. for 2 hours. Thus, a carrier was prepared. Preparation of Developer (Two-component Developer)

Each of the IR toners 1 to 14 and the perylene black toners 1 to 2 was uniformly mixed with the carrier by a TURBULA MIXER (available from Willy A. Bachofen AG) at a revolution of 48 rpm for 5 minutes to be charged. Thus, developers 1 to 14 and perylene black developers 1 and 2 were each prepared.

The mixing ratio of the toner to the carrier was 5% by mass, which was equal to the initial toner concentration in the developer in the test machine.

Examples 1 to 12 and Comparative Examples 1 and 2

In a digital full-color multifunction peripheral IMAGIO NEO C600 manufactured by Ricoh Company, Ltd. (hereinafter "NEO C600") containing black developer, yellow developer, magenta developer, and cyan developer, the black developer was replaced with each of the two-component developers 1 to 14, so that the NEO C600 was equipped with a toner set including IR toner and color toners.

The absorbance of each of yellow, magenta, and cyan toners contained in the yellow, magenta, and cyan developers, respectively, at a wavelength of 800 nm or more was less than 0.01.

Measurement of Absorbance

A solid patch having a toner deposition amount of 0.5 $mg/cm^2$ was output on an OHP film (TYPE PPC-FC manufactured by Ricoh Company, Ltd.) by the NEO C600. The solid patch and a blank OHP film with no image were subjected to a measurement by a spectrophotometer (V-660DS manufactured by JASCO Corporation) to determine a spectral transmittance T within a range of from 800 to 900 nm. An absorbance A was calculated based on the above-obtained spectral transmittance T according to the following equation (1).

$$A=-\log T \quad (1)$$

Evaluation of Deposition Amount and Gloss Value

First, a solid patch of 5 cm×5 cm of each color toner was output on a paper sheet (TYPE 6000 (70 W) manufactured by Ricoh Co., Ltd.). The deposition amount and gloss value (60-degree gloss value) of the color toner in each patch are presented in Table 2.

Evaluation of Deposition Amount

After removing the fixing unit from the NEO C600, an unfixed solid patch of 5 cm×5 cm was output thereby. The solid patch was cut out with scissors into a cutout piece. The mass of the cutout piece was measured with a precision balance. After the toner in the solid patch portion (unfixed image portion) was blown off with an air gun, the mass of the cutout piece was measured again. The toner deposition amount was calculated from the mass of the cutout piece before and after the toner had been blown off by the air gun according to the following formula. The results are presented in Table 1.

Toner Deposition Amount ($mg/cm^2$)=((Mass of Cutout Piece with Solid Patch)−(Mass of Cutout Piece after Blowing of Toner))/25

Evaluation of Gloss Value

A fixed solid patch of 5 cm×5 cm outputted by the NEO C600 was subjected to a measurement of gloss value using a gloss meter (VGS-1D manufactured by Nippon Denshoku Industries Co., Ltd.) at four positions. The average value of the measurement results at the four positions was calculated and determined as a gloss value. The results are presented in Table 1.

Evaluation of Visibility and Readability

Visibility and readability were evaluated as follows.

Figure 15:
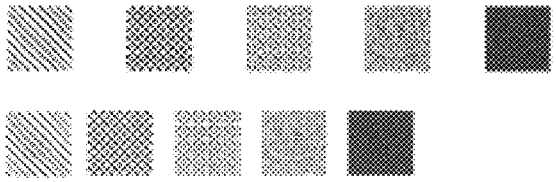
FIG. 15 is a diagram of patterns formed only of color toner images.
Figure 16:
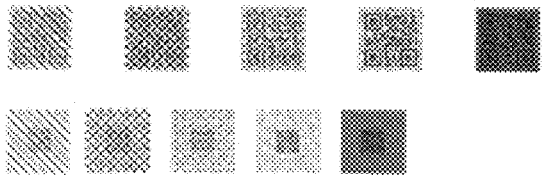
FIG. 16 is a diagram of patterns obtained by superimposing the patterns illustrated in FIG. 15 on IR toner images.

Using the apparatus and paper sheet presented in Table 3, QR codes (registered trademark) were printed with each IR toner, and patterns illustrated in FIG. 15 were further printed thereon, thus making the QR codes concealed by the patterns as illustrated in FIG. 16.

Figure 17:
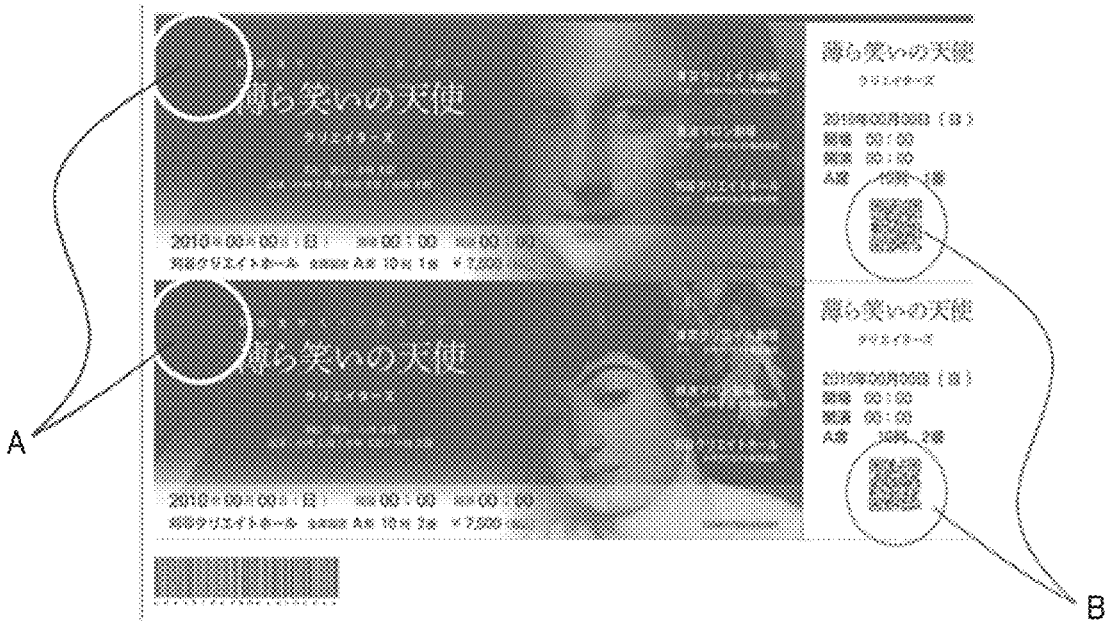
FIG. 17 is a diagram of an image obtained by superimposing a color toner image on an IR toner image.

An image illustrated in FIG. 17 contains an image portion A and an image portion B. The image portion A is an entirely colored portion in which a QR code (registered trademark) is printed with an IR toner. The image portion B contains a QR code printed with a color toner and another QR code (registered trademark) printed with an IR toner below the QR code printed with the color toner, each containing different information.

Visibility of the IR toner image and readability of the QR code (registered trademark) in the image outputted with the IR toner were evaluated from the printed matter of FIGS. 16 and 17. The results are presented in Table 3. It is to be noted that invisible IR toner images are drawn visualized in FIG. 16 for the purpose of explanation.

Evaluation of Visibility

Visibility was ranked by the number of persons, among 20 randomly extracted monitors, who were able to visually recognize the QR code (registered trademark) formed of IR image in the printed matter of FIG. 17. When the number of persons was 2 or less, visibility was ranked A. When the number of person was from 3 to 5, visibility was ranked B. When the number of person was 6 or more, visibility was ranked C.

Evaluation of Readability

The images illustrated in FIGS. 16 and 17 were each printed on 10 sheets of paper. All the QR codes (registered trademark) formed of IR image in the output image were read by a two-dimensional bar code reader (model number: CM-2D200K2B available from A-POC Corporation, modified with a 870 nm bandpass filter (870 nm BPF manufactured by CERATECH JAPAN Co., Ltd.)). In a case in which all the QR codes (registered trademark) were readable by one scan, readability was ranked A. In a case in which all the QR codes (registered trademark) were readable but some of them needed multiple times of scan, readability was ranked B. In a case in which at least one of the QR codes (registered trademark) was unreadable, readability was ranked C.

Example 13

A printer containing four color toners, i.e., yellow toner, magenta toner, cyan toner, and black toner (manufactured by Ricoh Company, Ltd.) was used. The black toner of the printer was replaced with the IR toner 2, so that a toner set including the IR toner and the color toners was prepared.

The absorbance of each of the color toners (yellow, magenta, and cyan toner) at a wavelength of 800 nm or more was less than 0.01.

As a paper sheet, COATED GLOSSY PAPER (135 $g/m^2$ manufactured by Mondi Group) was used. A solid patch of 5 cm×5 cm was output to the paper sheet using each color toner of the color toner set, and the deposition amount and gloss value of each color toner were measured in the same manner as in the above-described procedure. Measurement results are presented in Table 4.

Next, visibility and readability of the IR toner image were evaluated from the printed matter of FIGS. 16 and 17 in the same manner as in the above-described procedure. The results are presented in Table 4.

Comparative Example 3

The procedure in Example 13 was repeated except for replacing the IR toner 2 with the IR toner 12. The results are presented in Table 4.

Example 14

The procedure in Example 13 was repeated except for replacing the IR toner 2 with the IR toner 13. The results are presented in Table 4.

TABLE 3-continued

| | *Apparatus and Paper | IR Toner | Visibility | Readability | Judgement |
|---|---|---|---|---|---|
| Example 6 | 1 | 6 | A | A | A |
| Example 7 | 1 | 7 | A | A | A |
| Example 8 | 1 | 9 | A | B | B |
| Example 9 | 1 | 10 | A | B | B |
| Example 10 | 1 | 11 | B | A | B |
| Comparative Example 1 | 1 | 8 | C | A | C |
| Comparative Example 2 | 1 | 12 | C | C | C |
| Example 11 | 1 | 13 | A | A | A |
| Example 12 | 1 | 14 | A | A | A |

TABLE 1

| | Developer No. | Addition Amount of Near-infrared Absorbing Material (parts by mass) | Particle Diameter (μm) | *Apparatus and Paper 1 Deposition Amount (mg/cm$^2$) | *Apparatus and Paper 1 Gloss Value of Solid Portion | *Apparatus and Paper 2 Deposition Amount (mg/cm$^2$) | *Apparatus and Paper 2 Gloss Value of Solid Portion | Loss Tangent (tanδi) at 100° C.-140° C. |
|---|---|---|---|---|---|---|---|---|
| IR Toner 1 | 1 | 0.3 | 5.2 | 0.3 | 50 | 0.3 | 90 | 4-10 |
| IR Toner 2 | 2 | 0.6 | 5.2 | 0.35 | 50 | 0.35 | 94 | 4-10 |
| IR Toner 3 | 3 | 1.0 | 5.2 | 0.45 | 50 | 0.45 | 96 | 4-10 |
| IR Toner 4 | 4 | 0.6 | 5.2 | 0.35 | 36 | 0.35 | 58 | 3-8 |
| IR Toner 5 | 5 | 0.6 | 5.2 | 0.35 | 36 | 0.35 | 58 | 3-8 |
| IR Toner 6 | 6 | 0.3 | 6.8 | 0.35 | 34 | 0.35 | 58 | 3-8 |
| IR Toner 7 | 7 | 0.6 | 6.8 | 0.35 | 33 | 0.35 | 57 | 3-8 |
| IR Toner 8 | 8 | 0.6 | 5.2 | 0.35 | 12 | 0.35 | 33 | 0.4-1.2 |
| IR Toner 9 | 9 | 0.6 | 8.0 | 0.35 | 30 | 0.35 | 58 | 3-8 |
| IR Toner 10 | 10 | 0.2 | 5.2 | 0.3 | 51 | 0.3 | 90 | 4-10 |
| IR Toner 11 | 11 | 1.2 | 5.2 | 0.45 | 50 | 0.45 | 62 | 3-8 |
| IR Toner 12 | 12 | 0.6 | 5.2 | 0.35 | 3 | 0.35 | 5 | 0-0.2 |
| IR Toner 13 | 13 | 1.0 | 6.8 | 0.35 | 34 | 0.35 | 58 | 3-8 |
| IR Toner 14 | 14 | 2.0 | 6.8 | 0.4 | 37 | 0.4 | 62 | 3-8 |

TABLE 2

| | *Apparatus and Paper 1 Particle Diameter (μm) | *Apparatus and Paper 1 Deposition Amount (mg/cm$^2$) | *Apparatus and Paper 1 Gloss Value of Solid Portion | *Apparatus and Paper 1 Loss Tangent (tanδc) at 100° C.-140° C. | *Apparatus and Paper 2 Particle Diameter (μm) | *Apparatus and Paper 2 Deposition Amount (mg/cm$^2$) | *Apparatus and Paper 2 Gloss Value of Solid Portion | *Apparatus and Paper 2 Loss Tangent (tanδc) at 100° C.-140° C. |
|---|---|---|---|---|---|---|---|---|
| Yellow Toner | 6.8 | 0.5 | 18 | 0.4-1.6 | 5.2 | 0.4 | 33 | 0.4-1.2 |
| Magenta Toner | 6.8 | 0.5 | 16 | 0.4-1.6 | 5.2 | 0.4 | 30 | 0.4-1.2 |
| Cyan Toner | 6.8 | 0.5 | 18 | 0.4-1.6 | 5.2 | 0.4 | 34 | 0.4-1.2 |

TABLE 3

| | *Apparatus and Paper | IR Toner | Visibility | Readability | Judgement |
|---|---|---|---|---|---|
| Example 1 | 1 | 1 | A | A | A |
| Example 2 | 1 | 2 | A | A | A |
| Example 3 | 1 | 3 | A | A | A |
| Example 4 | 1 | 4 | A | A | A |
| Example 5 | 1 | 5 | A | A | A |

TABLE 4

| | *Apparatus and Paper | IR Toner | Visibility | Readability | Judgement |
|---|---|---|---|---|---|
| Example 13 | 2 | 2 | A | A | A |
| Comparative Example 3 | 2 | 12 | C | C | C |
| Example 14 | 2 | 13 | A | A | A |

In Tables 1 to 4, "*Apparatus and Paper 1" and "*Apparatus and Paper 2" refer to the following combinations of apparatus and paper.

Apparatus and Paper 1: The apparatus is a four-color tandem machine manufactured by Ricoh Co., Ltd. and the paper is plain paper TYPE 6000 (70 W) manufactured by Ricoh Co., Ltd.

Apparatus and Paper 2: The apparatus is a four-color tandem machine manufactured by Ricoh Co., Ltd. and the paper is COATED GLOSSY PAPER.

In Tables 3 and 4, "Judgment" is ranked A when both visibility and readability are ranked A; ranked B when one of visibility and readability is ranked B; and ranked C when one of visibility and readability is ranked C. When "Judgment" is ranked A, it indicates that visibility and readability are good. When "Judgment" is ranked B, it indicates that visibility and readability are insufficient, but there is no problem in practical use. When "Judgment" is ranked C, it indicates that visibility and readability are insufficient, and there is a problem in practical use.

Embodiments of the present invention provides respective effects as follows.

First Embodiment

A first embodiment of the present invention provides an image forming apparatus to form a color-black image on a recording medium, where the color-black image comprises a color toner image formed with a color toner comprising at least one of yellow toner, magenta toner, and cyan toner and a black toner image formed with black toner. The image forming apparatus includes a unit holder to selectively and detachably hold a replaceable black toner unit including a black toner developing device configured to form the black toner image or a replaceable special toner unit including a special toner developing device configured to form a special toner image. The image forming apparatus further includes a processor to perform: a normal operation, when the unit holder holds the replaceable black toner unit, for forming the color-black image on the recording medium; and a special operation, when the unit holder holds the replaceable special toner unit, for forming a color-special image comprising the color toner image and the special toner image on the recording medium. The processor further performs a toner amount increase control to increase an amount of the color toner per unit area in the color toner image on the recording medium in the special operation than that in the normal operation.

In this embodiment, in the special operation during which the replaceable special toner unit is held by the unit holder, the amount of the color toner per unit area constituting the visible image is increased than that in the normal operation during which the replaceable black toner unit is held by the unit holder due to the toner amount increase control. This makes it possible to form a visible image containing a larger amount of toner per unit area on a hardly visible image as compared with that formed in the normal operation, thus increasing invisibility of the hardly visible image. Accordingly, it is possible to make it more difficult for human eyes to recognize the hardly visible image.

In addition, according to this embodiment, it is possible to solve a problem of size increase and cost increase of the apparatus and another problem of large toner consumption in expressing black color by a color printer which outputs black color with the three color toners.

Second Embodiment

A second embodiment of the present invention provides the image forming apparatus according to the first embodiment in which, in the toner amount increase control in the special operation, a toner image that corresponds to the black toner image formed in the normal operation is formed with at least two of the yellow toner, the magenta toner, and the cyan toner.

The black toner image formed in the normal operation can be replaced with a toner image formed with at least two of the yellow toner, the magenta toner, and the cyan toner. By this replacement, the amount of toner per unit area constituting the visible image is increased. In other words, the amount of toner per unit area in the toner image formed with two or more color toners becomes larger than that in the black toner image formed only with the black toner. According to this embodiment, invisibility of a hardly visible image is increased to make it more difficult for human eyes to recognize the hardly visible image.

Third Embodiment

A third embodiment of the present invention provides the image forming apparatus according to the first or second embodiment in which, in the special operation, the processor executes a control to form the special toner image from a position relatively closer to the recording medium than a position where the color toner image is formed.

According to this embodiment, invisibility of a hardly visible image can be improved.

Fourth Embodiment

A fourth embodiment of the present invention provides the image forming apparatus according to any one of the first to third embodiments further including a fixing device (for example, a fixing device 21) to fix a toner image on a recording medium, in which, in the special operation, when the processor determines that the toner image, comprising the color toner image and the special toner image, contains an unfixable portion where a total amount of toner per unit area is in excess of an upper limit (for example, the second specified value) of a fixable amount of toner in one time of fixing processing, the processor performs an image processing (for example, the toner total amount regulation processing) to reduce the total amount of toner in the unfixable portion to a value not more than the upper limit of the fixable amount of toner.

According to this embodiment, in the special operation, it is possible to form an image with the total amount of toner per unit area in the unfixable portion be equal to or less than the upper limit of the amount of toner fixable by one time of fixing processing. Therefore, it is possible to complete the image formation by one time of fixing process while suppressing defective fixing.

Fifth Embodiment

A fifth embodiment of the present invention provides the image forming apparatus according to the fourth embodiment in which the processor performs the image processing only on the unfixable portion.

According to this embodiment, since the amount of the color toner in a portion other than the unfixable portion remains the same as that in the normal operation, the image quality in the portion other than the unfixable portion is suppressed from changing.

Sixth Embodiment

A sixth embodiment of the present invention provides the image forming apparatus according to any one of the first to fifth embodiments further including a memory (for example, the memory unit 32) to store normal color conversion data (for example, the normal color conversion decomposition table) and special color conversion data (for example, the special color conversion decomposition table) used in the normal operation and the special operation, respectively, to convert color information of input image information into another color information used for the image forming apparatus, in which the processor forms an image from the input image information converted with the normal color conversion data and the special color conversion data in the normal image forming operation and the toner amount suppression control, respectively.

According to this embodiment, the toner amount increase control can be performed relatively easily.

Seventh Embodiment

A seventh embodiment of the present invention provides the image forming apparatus according to any one of the first to sixth embodiments further including a fixing device to fix a toner image on a recording medium, in which the processor performs, in the special operation, a fixing condition change control to increase a fixing ability of the fixing device and/or lengthens a fixing processing time by the fixing device than those in the normal operation.

According to this embodiment, due to the fixing condition change control, the upper limit of the total amount of toner per unit area fixable by one time of fixing process can be increased. As a result, even when the amount of the color toner per unit area is increased by the toner amount increase control, it is possible to complete the image formation by one time of fixing process while suppressing defective fixing.

Eighth Embodiment

An eighth embodiment of the present invention provides the image forming apparatus according to any one of the first to seventh embodiments in which the special toner forms a hardly visible image.

According to this embodiment, invisibility of a hardly visible image is increased to make it more difficult for human eyes to recognize the hardly visible image.

Ninth Embodiment

A ninth embodiment of the present invention provides the image forming apparatus according to any one of the first to eighth embodiments in which the special toner is a transparent toner (for example, an IR toner) having transparency.

According to this embodiment, invisibility of a hardly visible image formed with the transparent toner is increased to make it more difficult for human eyes to recognize the hardly visible image formed with the transparent toner.

Tenth Embodiment

A tenth embodiment of the present invention provides the image forming apparatus according to the ninth embodiment in which the transparent toner is a watermark toner whose visibility is increased under light outside a visible light region.

According to this embodiment, since the special toner image included in the color-special image formed on the recording medium is formed by the watermark toner whose visibility is increased under light outside the visible light region, the color-special image on the recording medium can be utilized as a watermark image.

Eleventh Embodiment

An eleventh embodiment of the present invention provides the image forming apparatus according to the ninth or tenth embodiment in which the color toner comprises a binder resin and a colorant, the transparent toner comprises a binder resin and a near-infrared absorbing material, and a 60-degree gloss value of a solid image of the transparent toner is 30 or more and is 10 degrees or more higher than a 60-degree gloss value of a solid image of the color toner.

According to this embodiment, invisibility of a barely visible image formed with the transparent toner can be improved.

Twelfth Embodiment

A twelfth embodiment of the present invention provides the image forming apparatus according to any one of the ninth to eleventh embodiment in which the transparent toner comprises a binder resin and a near-infrared absorbing material and has a loss tangent (tan $\delta i$) of 2.5 or more in a temperature range of from 100° C. to 140° C. and the color toner comprises a binder resin and a colorant and has a loss tangent (tan $\delta c$) of 2 or less in a temperature range of from 100° C. to 140° C.

According to this embodiment, accuracy in reading a hardly visible image formed with the transparent toner can be reliably secured.

Thirteenth Embodiment

A thirteenth embodiment of the present invention provides the image forming apparatus according to any one of the ninth to twelfth embodiments in which the transparent toner has a weight average particle diameter of from 5 to 7 μm.

According to this embodiment, a hardly visible image formed with the transparent toner has high image quality.

Fourteenth Embodiment

A fourteenth embodiment of the present invention provides the image forming apparatus according to any one of the ninth to thirteenth embodiments in which a solid image of the color toner has an absorbance less than 0.05 at 800 nm or more.

According to this embodiment, accuracy in reading a hardly visible image formed with the transparent toner can be reliably secured.

Fifteenth Embodiment

A fifteenth embodiment of the present invention provides the image forming apparatus according to any one of the ninth to fourteenth embodiments in which, when a two-dimensional code image comprising the special toner image and another two-dimensional code image comprising a solid image of the color toner image, each containing different information, are superimposed on one another in the special operation, the solid image of the color toner image has an absorbance less than 0.05 in a range of from 800 to 900 nm.

According to this embodiment, accuracy in reading a two-dimensional code image formed of the hardly visible image can be reliably secured.

Sixteenth Embodiment

A sixteenth embodiment of the present invention provides the image forming apparatus according to any one of the first to fifteenth embodiments in which, in the special operation, the processor adjusts an amount of the special toner in the special toner image per unit area to be in a range of from 0.30 to 0.45 mg/cm$^2$ and to be smaller than an amount of the color toner in the color toner image per unit area.

According to this embodiment, accuracy in reading a hardly visible image can be reliably secured.

Seventeenth Embodiment

A seventeenth embodiment of the present invention provides the image forming apparatus according to any one of the first to sixteenth embodiments further including an information reader (for example, the ID chip reader 43B and the barcode reader 44B) to read identification information for identifying the replaceable black toner unit or the replaceable special toner unit from an information recording portion (for example, the ID chip 41B and the barcode image 42B) of the replaceable black toner unit or the replaceable special toner unit, respectively, which is held by the unit holder, in which the processor determines whether the unit holder holds the replaceable black toner unit or the replaceable special toner unit based on the identification information read by the information reader.

According to this embodiment, it is possible to execute an appropriate control according to the type of replaceable unit held by the unit holder.

Eighteenth Embodiment

An eighteenth embodiment of the present invention provides the image forming apparatus according to the seventeenth embodiment in which the information recording portion is a code image encoding the identification information.

According to this embodiment, a simple configuration is provided.

Nineteenth Embodiment

A nineteenth embodiment of the present invention provides the image forming apparatus according to the seventeenth embodiment in which the information recording portion is a mechanical key having an outer shape corresponding to the identification information.

According to this embodiment, a simple configuration is provided.

Twentieth Embodiment

A twentieth embodiment of the present invention provides the image forming apparatus according to any one of the first to nineteenth embodiments further including an operation device (for example, the operation panel 50) to receive a user operation, in which the processor determines whether the unit holder holds the replaceable black toner unit or the replaceable special toner unit based on the user operation received by the operation device.

According to this embodiment, it is possible to determine whether the unit holder holds the replaceable black toner unit or the replaceable special toner unit without any additional configuration for determination.

Twenty-First Embodiment

A twenty-first embodiment of the present invention provides the image forming apparatus according to any one of the first to twentieth embodiments further including an optical sensor (for example, the toner deposition amount detection sensor 60) to detect a test toner image, in which the processor forms the test toner image with the replaceable black toner unit or the replaceable special toner unit which is held by the unit holder and determines whether the unit holder holds the replaceable black toner unit or the replaceable special toner unit based on a detection result obtained by the optical sensor.

According to this embodiment, it is possible to determine whether the unit holder holds the replaceable black toner unit or the replaceable special toner unit without any additional configuration for determination.

Twenty-Second Embodiment

A twenty-second embodiment of the present invention provides the image forming apparatus according to any one of the first to twenty-first embodiments further including a toner container holder (for example, the container holder 102) to selectively hold a black toner container (for example, the black toner cartridge 26K) containing black toner to be supplied to the black toner developing device or a special toner container (for example, the IR toner cartridge 26IR) containing special toner to be supplied to the special toner developing device, in which the black toner contained in the black toner container is supplied to the black toner developing device when a connecting portion 28K of the black toner container is engaged with a connecting portion 29K of the black toner developing device, the special toner contained in the special toner container is supplied to the special toner developing device when a connecting portion 28IR of the special toner container is engaged with a connecting portion 29IR of the special toner developing device, the connecting portion 29K of the black toner developing device has a shape engageable with the connecting portion 28K of the black toner container but not engageable with the connecting portion 28IR of the special toner container, and the connecting portion 29IR of the special toner developing device has a shape engageable with the connecting portion 28IR of the special toner container but not engageable with the connecting portion 28K of the black toner container.

According to this embodiment, the toner cartridge which does not correspond to the process unit mounted on the unit holder is prevented from being mounted thereon, and the occurrence of toner color mixing is prevented, which is caused when the developing device of the process unit is supplied with toner different from the toner used in the developing device.

Twenty-Third Embodiment

A twenty-third embodiment of the present invention provides the image forming apparatus according to any one of the first to twenty-second embodiments further including a toner container holder to selectively hold a black toner container containing black toner to be supplied to the black toner developing device or a special toner container containing special toner to be supplied to the special toner developing device, in which the processor determines whether the unit holder holds the replaceable black toner unit or the replaceable special toner unit and whether the toner container holder holds the black toner container or the special toner container and prohibits a toner supply operation when determines that the replaceable black toner unit or the replaceable special toner unit, which is held by the unit holder, and the black toner container or the special toner container, which is held by the toner container holder, do not correspond to a same toner.

According to this embodiment, even when the toner cartridge which does not correspond to the process unit mounted on the unit holder is mounted thereon, the occurrence of toner color mixing is prevented, which is caused when the developing device of the process unit is supplied with toner different from the toner used in the developing device.

Twenty-Fourth Embodiment

A twenty-fourth embodiment of the present invention provides the image forming apparatus according to any one of the first to twenty-third embodiments in which the optical sensor emits light to a test toner image and receives specular reflection light and diffuse reflection light from the test toner image, in which the processor detects a deposition amount of toner in the test toner image from only an amount of the specular reflection light received by the optical sensor when the test toner image is formed with the black toner, and from both an amount of the specular reflection light and an amount of the diffuse reflection light received by the optical sensor when the test toner image is formed with the special toner.

According to this embodiment, both the toner deposition amount in the black toner test image and the toner deposition amount in the special toner test toner image can be detected more accurately.

Twenty-Fifth Embodiment

A twenty-fifth embodiment of the present invention provides printed matter comprising a recording medium on which the color-special image is formed by the image forming apparatus according to any one of the first to twenty-fourth embodiments.

According to this embodiment, printed matter of a hardly visible image having high invisibility is provided.

Twenty-Sixth Embodiment

A twenty-sixth embodiment of the present invention provides the printed matter according to the twenty-fifth embodiment in which the special toner image comprises the special toner image that is a watermark image.

According to this embodiment, printed matter of a watermark image having high invisibility is provided.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. An image forming apparatus comprising:

an image forming unit including:

a color toner unit including a color toner developing device containing a color toner comprising at least one of yellow toner, magenta toner, and cyan toner, the color toner developing device configured to form a color toner image with the color toner on a recording medium;

a replaceable black toner unit including a black toner developing device containing black toner, the black toner developing device configured to form a black toner image with the black toner on the recording medium; and a replaceable special toner unit including a special toner developing device containing a special toner, the special toner developing device configured to form a special toner image with the special toner on the recording medium;

a unit holder configured to selectively and detachably hold the replaceable black toner unit or the replaceable special toner unit; and circuitry to control the image forming unit to:

form a color-black image on the recording medium, including the color toner image and the black toner image, during a normal operation when the unit holder holds the replaceable black toner unit; and form a color-special image on the recording medium, including the color toner image and the special toner image, during a special operation when the unit holder holds the replaceable special toner unit;

wherein an amount of the color toner per unit area, in the color toner image formed on the recording medium, is relatively increased during the special operation relative to the normal operation.

2. The image forming apparatus of claim 1, wherein, in the special operation, the circuitry controls the amount of toner increase by controlling the image forming unit to form a toner image that corresponds to the black toner image formed in the normal operation with at least two of the yellow toner, the magenta toner, and the cyan toner.

3. The image forming apparatus of claim 1, wherein the circuitry is configured to control the image forming unit to form the special toner image from a position relatively closer to the recording medium than a position where the color toner image is formed.

4. The image forming apparatus of claim 1, further comprising:

a fixing device configured to fix a toner image on the recording medium, wherein, in the special operation, when the circuitry determines that the toner image, comprising the color toner image and the special toner image, contains an unfixable portion where a total amount of toner per unit area is in excess of an upper limit of a fixable amount of toner in one time of fixing processing, the circuitry performs an image processing that reduces the total amount of toner in the unfixable portion to a value not more than the upper limit of the fixable amount of toner.

5. The image forming apparatus of claim 4, wherein the circuitry performs the image processing only on the unfixable portion.

6. The image forming apparatus of claim 1, further comprising:

a memory to store normal color conversion data and special color conversion data used in the normal operation and the special operation, respectively, to convert color information of input image information into another color information used for the image forming apparatus, wherein the circuitry controls the image forming unit to form an image from the input image information converted with the normal color conversion data and the special color conversion data in the normal operation and the special operation, respectively.

7. The image forming apparatus of claim 1, further comprising:

a fixing device configured to fix a toner image on the recording medium, wherein the circuitry is further configured to perform a fixing condition change control including at least one of relatively increasing a fixing ability of the fixing device and relatively lengthening a fixing processing time by the fixing device during the special operation, relative to the normal operation.

8. The image forming apparatus of claim 1, wherein the special toner image forms an image with visibility relatively increased under light outside the visible light region.

9. The image forming apparatus of claim 1, wherein the special toner is a transparent toner having transparency.

10. The image forming apparatus of claim 9, wherein the transparent toner has visibility that is increased under light outside a visible light region.

11. The image forming apparatus of claim 9, wherein the color toner comprises a binder resin and a colorant, wherein the transparent toner comprises a binder resin and a near-infrared absorbing material, wherein a 60-degree gloss value of a solid image of the transparent toner is 30 or more and is 10 degrees or more higher than a 60-degree gloss value of a solid image of the color toner, wherein the transparent toner comprises a binder resin and a near-infrared absorbing material, and has a loss tangent (tan δi) of 2.5 or more in a temperature range of from 100° C. to 140° C., wherein the color toner comprises a binder resin and a colorant, and has a loss tangent (tan δc) of 2 or less in a temperature range of from 100° C. to 140° C., wherein the transparent toner has a weight average particle diameter of from 5 to 7 μm, wherein a solid image of the color toner has an absorbance less than 0.05 at 800 nm or more, wherein, when a two-dimensional code image comprising the special toner image and another two-dimensional code image comprising a solid image of the color toner image, each containing different information, are superimposed on one another in the special operation, the solid image of the color toner image has an absorbance less than 0.05 in a range of from 800 to 900 nm.

12. The image forming apparatus of claim 1, wherein the circuitry is configured to adjust an amount of the special toner in the special toner image per unit area, during the special operation, to be in a range of from 0.30 to 0.45 mg/cm$^2$ and to be relatively smaller than an amount of the color toner in the color toner image per unit area.

13. The image forming apparatus of claim 1, further comprising:

an information reader configured to read identification information to identify the replaceable black toner unit or the replaceable special toner unit from an information recording portion of the replaceable black toner unit or the replaceable special toner unit, respectively, held by the unit holder, wherein the circuitry determines whether the unit holder holds the replaceable black toner unit or the replaceable special toner unit based on the identification information read by the information reader.

14. The image forming apparatus of claim 1, further comprising:

an operation device configured to receive a user operation, wherein the circuitry determines whether the unit holder holds the replaceable black toner unit or the replaceable special toner unit based on the user operation received by the operation device.

15. The image forming apparatus of claim 1, further comprising:

an optical sensor configured to detect a test toner image, wherein the circuitry controls the image forming unit to form the test toner image with the replaceable black toner unit or the replaceable special toner unit which is held by the unit holder and determines whether the unit holder holds the replaceable black toner unit or the replaceable special toner unit based on a detection result obtained by the optical sensor.

16. The image forming apparatus of claim 1, further comprising:

a black toner container storing the black toner to be supplied to the black toner developing device, the black toner container having a connecting portion having a shape engageable with a connecting portion of the black toner developing device but not engageable with a connecting portion of the special toner developing device;

a special toner container storing the special toner to be supplied to the special toner developing device, the special toner container having a connecting portion having a shape engageable with the connecting portion of the special toner developing device but not engageable with the connecting portion of the black toner developing device; and a toner container holder configured to selectively hold the black toner container or the special toner container, wherein the black toner stored in the black toner container is supplied to the black toner developing device when the connecting portion of the black toner container is engaged with the connecting portion of the black toner developing device, wherein the special toner stored in the special toner container is supplied to the special toner developing device when the connecting portion of the special toner container is engaged with the connecting portion of the special toner developing device.

17. The image forming apparatus of claim 1, further comprising:

a black toner container storing the black toner to be supplied to the black toner developing device;

a special toner container storing the special toner to be supplied to the special toner developing device; and a toner container holder configured to selectively hold the black toner container or the special toner container, wherein the circuitry determines whether the unit holder holds the replaceable black toner unit or the replaceable special toner unit and whether the toner container holder holds the black toner container or the special toner container, wherein the circuitry prohibits a toner supply operation when the circuitry determines that the replaceable black toner unit or the replaceable special toner unit, which is held by the unit holder, and the black toner container or the special toner container, which is held by the toner container holder, do not correspond to a same toner.

18. The image forming apparatus of claim 15, wherein the optical sensor is configured to emit light to a test toner image and receive specular reflection light and diffuse reflection light from the test toner image, wherein the circuitry detects a deposition amount of toner in the test toner image from:

only an amount of the specular reflection light received by the optical sensor when the test toner image is formed with the black toner; and both an amount of the specular reflection light and an amount of the diffuse reflection light received by the optical sensor when the test toner image is formed with the special toner.

19. Printed matter comprising:

a recording medium; and the color-special image formed by the image forming apparatus of claim 1.

20. The printed matter of claim 19, wherein the color-special image comprises the special toner image whose visibility is increased under light outside a visible light region.

21. An image forming apparatus comprising:

at least one color toner developing device containing one color toner, the at least one color toner developing device including at least one of a color toner developing device containing a yellow color toner, a color toner developing device containing a magenta color toner, and a color toner developing device containing a cyan color toner;

a special toner developing device containing a special toner; and circuitry to control the at least one color toner developing device and the special toner developing device to, during a first operation and during a second operation, form:

an image on a recording medium without using the special toner, during the first operation; and a special image on a recording medium, including a color toner image including the at least one color toner and a special toner image including the special toner. during the second operation;

wherein an amount of the color toner per unit area in the color toner image formed during the second operation is increased relative to the amount of toner per unit area in a toner image formed during the first operation, including a same color as the color toner image.

22. The image forming apparatus of claim 21, wherein the image forming apparatus includes at least two color toner developing devices, each color toner developing device containing one color toner, including at least two of the color toner developing device containing the yellow color toner, the color toner developing device containing the magenta color toner, and a color toner developing device containing the cyan color toner, and wherein, during the second operation, the circuitry controls the amount of toner increase by controlling the at least two color toner developing devices to form a toner image that corresponds to the toner image formed during the first operation, including at least two of the yellow toner, the magenta toner, and the cyan toner.

23. The image forming apparatus of claim 22, wherein the circuitry is configured to control the at least two color toner developing devices to form the special toner image from a position relatively closer to the recording medium than a position where the color toner image is formed.

24. The image forming apparatus of claim 21, further comprising: a fixing device configured to fix a toner image on the recording medium, wherein, during the second operation, when the circuitry determines that an amount of toner in the toner image, including the color toner image and the special toner image, is in excess of a specified value, the circuitry performs an image processing that reduces the amount of toner to a value not more than the specified value.

25. The image forming apparatus of claim 24, wherein the circuitry performs the image processing only on a portion of the toner image where the amount of toner is in excess of the specified value.

26. The image forming apparatus of claim 25, further comprising:

a memory to store a normal color conversion data and special color conversion data used in the first operation and the second operation, respectively, to convert color information of input image information into another color information used for the image forming apparatus, wherein the circuitry controls the toner developing devices to form an image from the input image information converted with the normal color conversion data and the special color conversion data in the first operation and the second operation, respectively.

27. The image forming apparatus of claim 21, further comprising:

a fixing device configured to fix a toner image on the recording medium, wherein the circuitry is further configured to perform a fixing condition change control including changing a fixing speed of the fixing device during the second operation, from the fixing speed of the fixing device during the first operation.

28. The image forming apparatus of claim 21, further comprising:

a fixing device configured to fix toner image on the recording medium, wherein the circuitry if further configured to perform a fixing condition change control including changing a nip pressure of the fixing device during the second operation, from the nip pressure of the fixing device during the first operation.

29. The image forming apparatus of claim 21, further comprising:

a fixing device configured to fix a toner image on the recording medium, wherein the circuitry is further configured to perform a fixing condition change control including changing a fixing temperature of the fixing device during the second operation from the fixing temperature of the fixing device during the first operation.

30. The image forming apparatus of claim 21, wherein the special toner image forms an image with visibility relatively increased under light outside a visible light region.

31. The image forming apparatus of claim 21, wherein the special toner is a transparent toner having transparency.

32. The image forming apparatus of claim 31, wherein the transparent toner has visibility that is increased under light outside a visible light region.

* * * * *